United States Patent [19]

Nishijima et al.

[11] Patent Number: 4,912,027

[45] **Date of Patent: * Mar. 27, 1990**

[54] SILVER HALIDE PHOTOGRAPHIC LIGHT-SENSITIVE MATERIAL

[75] Inventors: Toyoki Nishijima; Kaoru Onodera, both of Odawara, Japan

[73] Assignee: Konishiroku Photo Industry Co., Ltd., Tokyo, Japan

[ * ] Notice: The portion of the term of this patent subsequent to Jan. 23, 2004 has been disclaimed.

[21] Appl. No.: 262,090

[22] Filed: Oct. 24, 1988

Related U.S. Application Data

[63] Continuation of Ser. No. 851,143, Apr. 11, 1986, abandoned.

[30] Foreign Application Priority Data

Apr. 19, 1985 [JP] Japan ..... 60-85162

[51] Int. Cl.[4] ..... G03C 7/38; G03C 1/34

[52] U.S. Cl. ..... 430/551; 430/558; 430/372

[58] Field of Search ..... 430/558, 551, 931, 554, 430/449, 386, 387, 372

[56] References Cited

U.S. PATENT DOCUMENTS

| | | | |
|---|---|---|---|
| 4,533,625 | 8/1985 | Ichijima et al. | 430/552 |
| 4,540,653 | 9/1985 | Nishijima et al. | 430/372 |
| 4,590,153 | 5/1986 | Kawagishi et al. | 430/551 |
| 4,607,002 | 8/1986 | Nakayama et al. | 430/505 |
| 4,675,275 | 6/1987 | Nishijima et al. | 430/372 |
| 4,684,603 | 8/1987 | Nishijima et al. | 430/551 |
| 4,695,533 | 9/1987 | Nakayama et al. | 430/558 |
| 4,752,561 | 6/1988 | Nishijima et al. | 430/551 |
| 4,795,696 | 1/1989 | Sasaki et al. | 430/558 |

FOREIGN PATENT DOCUMENTS

| | | |
|---|---|---|
| 60-51834 | 3/1985 | Japan . |
| 1072243 | 4/1986 | Japan . |
| 8601915 | 3/1986 | World Int. Prop. O. . |

OTHER PUBLICATIONS

Nakayama et al.-U.S. Pat. application 845881, Filed 5/28/86, Assignee Konishiroku Photo Industry Co., Ltd.

*Primary Examiner*—Paul R. Michl
*Assistant Examiner*—Lee C. Wright
*Attorney, Agent, or Firm*—Frishauf, Holtz, Goodman & Woodward

[57] ABSTRACT

A silver halide photographic light-sensitive material which comprises at least one of 1H-pyrazolo[5,1-Cl-1,2,4-triazole-type magenta couplers substituted by a compound having the following Formula [I] in the third position and at least one of these compounds having the following Formulas [II], [III] and [IV];

$$-R^1-SO_2-R^2 \qquad \text{Formula [I]}$$

wherein $R^1$ is an alkylene group having not less than three carbon atoms in the straight-chain portion which serves as an linkage group between the third-position carbon of the 1H-pyrazolo[5,1-Cl-1,2,4-triazole and the $-SO_2-$, and $R^2$ is an alkyl group, a cycloalkyl group, or aryl group;

Formula [II]

Formula [III]

Formula [IV]

In Formula [II], Formula [III] and formula [IV], M is a metallic atom; $X^1$ and $X^2$ each is an oxygen atom, a sulfur atom, or a $-NR^7-$(wherein $R^7$ is a hydrogen atom, an alkyl group, an aryl group or a hydroxyl group); $X^3$ is a hydroxyl group or a mercapto group; Y is an oxygen atom or a sulfur atom; $R^3$, $R^4$, $R^5$ and $R^6$ each is a hydrogen atom, a halogen atom, a cyano group, or an alkyl, aryl, cycloalkyl or heterocyclic group which combines with a carbon atom directly or through a divalent linkage group; and at least one of the $R^3$—$R^4$ and $R^5$—$R^6$ combinations may be allowed to combine along with carbon atoms to form a five- or six-member ring; further $Z^0$ represents a compound or a residue thereof coordinatable to M.

11 Claims, No Drawings

SILVER HALIDE PHOTOGRAPHIC LIGHT-SENSITIVE MATERIAL

This application is a continuation of application Ser. No. 851,143 filed Apr. 11, 1986, now abandoned.

BACKGROUND OF THE INVENTION

The present invention relates to a silver halide photographic light-sensitive material, and more particularly to a color reproducibility-improved silver halide color photographic light-sensitive material.

The formation of a dye image on a silver halide color photographic light sensitive material is normally carried out by the reaction of photographic couplers with the oxidized product of a color developing agent. Those favorably usable as the photographic couplers for the ordinary color reproduction are magenta, yellow and cyan couplers, and those preferably used as the color developing agent include aromatic primary amine-type color developing agents. The reactions of magenta and yellow couplers with the oxidized product of an aromatic primary amine-type color developing agent form dyes such as azomethine dyes, while the reaction of a cyan coupler with the oxidized product of such the aromatic primary amine-type color developing agent forms a dye such as indoaniline dye.

Of these the magenta dye image formation is made by use of one of those couplers including 5-pyrazolone-type couplers, cyanoacetophenone-type couplers, indazolone-type couplers, pyrazolobenzimidazole-type couplers, pyrazolotriazole-type couplers, and the like.

Those conventional magenta color image forming couplers which have been actually used to date are mostly 5-pyrazolonetype couplers. A color image that is formed from a 5-pyrazolone-type coupler is excellent in its stability against light or heat, but not excellent in the tint of the produced dye; there exists an yellow-component-containing undesirable absorption around 430 nm as well as a visible ray's broad absorption spectrum around 550 nm, which causes the formed color to be impure, thus resulting in a photographic image lacking in clearness.

As the coupler free of such undesirable absorptions there are those pyrazolotriazole-type couplers, imidazopyrazole-type couplers, pyrazolopyrazole-type couplers and pyrazolotetrazoletype couplers as described in U.S. Pat. No. 3,725,067, Japanese Patent Publication Open to Public Inspection (hereinafter referred to as Japanese Patent O.P.I. Publication) Nos. 162,548/1984 and 171,956/1984.

However, the fastness against light of a dye image that is formed from any of these couplers is extremely low. The use of these couplers in light-sensitive materials, particularly those usitable for direct appreciation, will impair the essential requirements for photographic materials such as the recording and storage of images.

Thus, these couplers have drawbacks to making them practical reality. Thereupon, as a method for improving the light resistance of them, the use of phenol-type or phenyl-ether-type oxidation inhibitors was devised, which is described in Japanese Patent O.P.I. Publication No. 125,732/1984.

The above method, however, may show little or a large light-resistance improving effect depending on the compound used, but the effect still remains not sufficient for making practical use of the agent in photo graphic materials. Accordingly, proposals of new techniques of further improving the light resistance have been hoped.

Upon this, we, the inventors of this invention, as a result of our investigation, found that a certain metallic complex compound is very useful for improving the light resistance.

However, there was the disadvantage that the light resistance improving effect is small or yellow stain on the white area by heat largely increases depending on the structure of the magenta coupler used. We found that these disadvantages could be removed by use of 1H-pyrazolo[3,2-C]-S-triazole-type couplers of wich the sixth position is substituted by a secondary alkyl group and the seventh position by a non-hydrogen split-off group. However, we found that there was still room for improvement on the prevention of increase in the yellow stain by heat, particularly where the light-sensitive material is stored for an extensive period.

SUMMARY AND OBJECTS OF THE INVENTION

As a result of our further investigation, we have now found that the increase in the yellow stain by heat can be lessened and the light resistance can be improved by use in combination of a certain magenta coupler and a certain metallic complex.

It is therefore a first object of the present invention to provide a silver halide photographic light-sensitive material which is excellent in the magenta dye image's color reproducibility as well as in the magenta dye image's fastness against light.

It is a second object of the present invention to provide a silver halide photographic light-sensitive material whose magenta dye's fastness against light is so excellent that little or no yellow stain on the white area by heat occurs even if the light-sensitive material is stored over an extensive period of time.

The above objects of the present invention can be accomplished by a silver halide photographic light-sensitive material comprising at least one of 1H-pyrazolo[5.1-C]-1,2,4-triazole-type magenta couplers substituted by a compound having the following Formula [I] in the third position and at least one of these compounds having the following Formulas [II], [III] or [IV]

DETAILED DESCRIPTION OF THE INVENTION $$-R^1-SO_2-R^2 \qquad \text{Formula [I]}$$

wherein $R^1$ represents an alkylene group having not less than three carbon atoms in the straight-chain portion serves as a linkage group between the $-SO_2-$ and the carbon atom in the third position of 1H-pyrazolo[5,1-C]-1,2,4-triazole; and $R^2$ is an alkyl group, a cycloalkyl group or an aryl group.

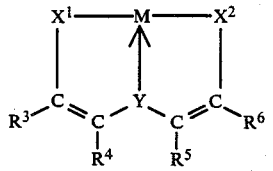

Formula [II]

-continued

Formula [III]

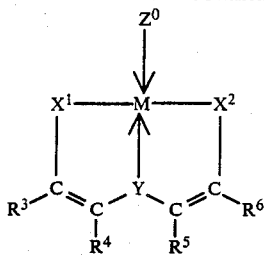

Formula [IV]

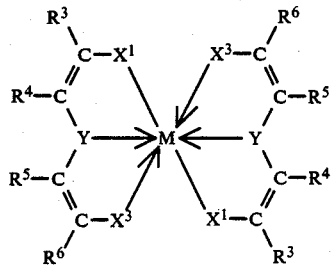

In Formulas [II], [III] and [IV], M represents a metallic atom; $X^1$ and $X^2$ each is an oxygen atom, a sulfur atom, or —$NR^7$— (wherein $R^7$ is a hydrogen atom, an alkyl group, an aryl group or a hydroxyl group); $X^3$ is a hydroxyl group or a mercapto group; Y is an oxygen atom or a sulfur atom; $R^3$, $R^4$, $R^5$ and $R^6$ each is a hydrogen atom, a halogen atom, a cyano group or an alkyl, aryl, cycloalkyl or heterocyclic group which is combined directly or through a divalent linkage group with a carbon atom; provided that at least one of the $R^3$–$R^4$ and $R^5$–$R^6$ combinations is allowed to be linked with each other to form a five- or six-member cyclic ring along with the carbon atom to be bonded; and $Z^0$ represents a compound or the residue thereof which is coordinatable to M.

The magenta coupler of this invention is a 1H-pyrazolo-[5,1-C]-1,2,4-triazole-type magenta coupler the third position of which is substituted by a group having the following Formula [I]

$$-R^1-SO_2-R^2$$

wherein $R^1$ is an alkylene group having not less than three carbon atoms, which alkylene group is the straight-chain portion of a carbon chain that combines the —$SO_2$— with the carbon atom in the third position of the 1H-pyrazolo-[5,1-C]-1,2,4-triazole; and $R^2$ is an alkyl, cycloalkyl or aryl group.

The alkylene group represented by $R^1$ has more than three carbon atoms, and preferably from three to six carbon atoms, in the straight-chain portion thereof, and is allowed to have a substituent.

The substituent includes, e.g., aryl groups, cyano group, halogens, heterocyclic groups, cycloalkyl groups, cycloalkenyl groups, spiro compound residues, cross-linked hydrocarbon compound residues, and such substituents which substitute through a carbonyl group as acyl, carboxy, carbomoyl, alkoxycarbonyl, aryloxycarbonyl, and the like groups, and further those substituents which substitute through a hetero atom; for example, those which substitute through an oxygen atom such as hydroxy, alkoxy, aryloxy, heterocyclic oxy, siloxy, acyloxy, and carbamoyloxy groups; those which substitute through a nitrogen atom such as nitro, amino (including dialkylamino, etc.), sulfamoylamino, alkoxycarbonylamino, aryloxycarbonylamino, acylamino, sulfonamido, imido, and ureido groups; those which substitute through a sulfur atom such as alkylthio, arylthio, heterocyclic thio, sulfonyl, sulfinyl, and sulfamoyl groups; and those which substitute through a phosphorus atom; and the like.

Preferred one among these substituents is phenyl.

Preferred examples of the alkylene group represented by $R^1$ are as follows:

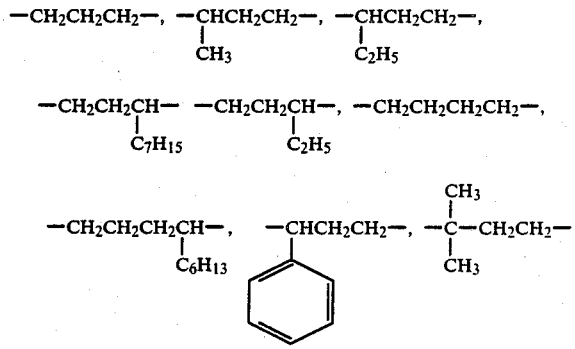

The alkyl group represented by $R^2$ is allowed to be of either straight chain or branched chain, which includes methyl, ethyl, propyl, iso-propyl, butyl, 2-ethyl-hexyl, octyl, dodecyl, tetradecyl, hexadecyl, octadecyl, 2-hexyldecyl, and the like groups.

The cycloalkyl group represented by $R^2$ is desirable to be of five- or six-member cyclic group, such as cyclohexyl.

The alkyl or cycloalkyl group represented by $R^2$ is allowed to have a substituent, the substituent including those exemplified previously as ones for the foregoing $R^1$.

The aryl group represented by $R^2$ includes phenyl and naphthyl. The aryl group is allowed to have a substituent, the substituent including those exemplified as ones for $R^1$ in addition to those alkyls of either straight chain or branched chain.

Where there are two or more substituents, they may be the same as or different from one anether.

Preferred among 1H pyrazolo[5,1-C]-1,2,4-triazole-type magenta couplers are those having the following Formula [II]:

Formula [II]

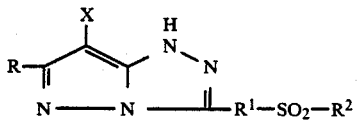

wherein $R^1$ and $R^2$ are the same as the $R^1$ and $R^2$ defined in Formula [I]; R represents a hydrogen atom or a substituent; and X represents a hydrogen atom or a substituent that can be split off as a result of the reaction with the oxidized product of a color developing agent.

The substituent represented by the above R includes, e.g., halogen atoms, alkyl groups, cycloalkyl groups, alkenyl groups, aryl groups, heterocyclic groups, acyl groups, sulfonyl groups, sulfinyl groups, phosphonyl groups, carbamoyl groups, sulfamoyl groups, cyano groups, spiro compound residues, cross-linked hydrocarbon compound residues, alkoxy groups, aryloxy groups, heterocyclic oxy groups, siloxy groups, acyloxy groups, carbamoyloxy groups, amino groups, acylamino groups, sulfonamido groups, imido groups, ureido groups, sulfamoylamino groups, alkoxycarbonylamino groups, aryloxycarbonylamino groups, alkoxycarbonyl groups, aryloxycarbonyl groups, alkylthio groups, arylthio groups, and heterocyclic thio groups.

The halogen atom includes, e.g., chlorine and bromine atoms, and particularly the chlorine atom is preferred.

Preferred as the alkyl group represented by R are those having from 1 to 32 carbon atoms; preferred as the alkenyl or alkinyl group are those having from 2 to 32 carbon atoms; preferred as the cycloalkyl or cycloalkenyl group are those having from 3 to 12 carbon atoms, and more preferably from 5 to 7 carbon atoms. The alkyl, alkenyl and alkinyl groups each is allowed to be of either a straight chain or branched chain.

These alkyl, alkenyl, alkinyl, cycloalkyl and cycloalkenyl groups are allowed to have substituents [such as aryl groups, cyano group, halogen atoms, heterocyclic groups, cycloalkyl groups, cycloalkenyl groups, spiro compound residues, cross-linked hydrocarbon compound residues, and those which substitute through a carbonyl group such as acyl, carboxy, carbamoyl, alkoxycarbonyl, aryloxycarbonyl, and further those which substitute through a hetero atom; for example, those which substitute through the oxygen atom of hydroxy, alkoxy, aryloxy, heterocyclic oxy, siloxy, acyloxy, carbamoyloxy, or the like; those which substitute through the nitrogen atom of nitro, amino (including dialkylamino, etc.), sulfamoylamino, aryloxycarbonylamino, acylamino, sulfonamido, imido, ureido, or the like; those which substitute through the sulfur atom of alkylthio, arylthio, heterocyclic thio, sulfonyl, sulfinyl, sulfamoyl, or the like; and those which substitute through the phosphorus atom of phosphonyl or the like.

To be more concrete, the substituent includes, e.g., methyl group, ethyl group, isopropyl group, t-butyl group, pentadecyl group, heptadecyl group, 1-hexylnonyl group, 1,1'-dipentyl-nonyl group, 2-chloro-t-butyl group, trifluoromethyl group, 1-ethoxytridecyl group, 1-methoxyisopropyl group, methanesulfonylethyl group, 2,4-di-t-amylphenoxymethyl group, anilino group, 1-phenylisopropyl group, 3-m-buthanesulfonaminophenoxypropyl group, 3-4'-{α-[4''(p-hydroxybenzenesulfonyl)phenoxy]-dodecanoylamino}phenyl-propyl group, 3-{4'-[α-(2'',4''-di-t-amylphenoxy)butaneamido]phenyl}-propyl group, 4-[α-(o-chlorophenoxy)tetradecanamidophenoxy]propyl group, aryl group, cyclopentyl group, cyclohexyl group, and the like.

Preferred as the aryl group represented by R is a phenyl group, the phenyl group being allowed to have a substituent (such as, e.g., an alkyl group, alkoxy group, acylamino group, and the like).

To be concrete, the substituent includes phenyl group, 4-t-butylphenyl group, 2,4-di-t-amylphenyl group, 4-tetradecaneamidophenyl group, hexadesiloxyphenyl group, 4'-[α-(4''-t-butylphenoxy)tetradecaneamido]phenyl group, and the like.

Preferred as the heterocyclic group represented by R are those of five- to 7-member ring, which are allowed to be either substituted or condensed, and include 2-furyl group, 2-thienyl group, 2-pyrimidinyl group, 2-benzothiazolyl group, and the like.

The acyl group represented by R includes, e.g., acetyl group, phenylacetyl group, dodecanoyl group, alkylcarbonyl groups such as α-2,4-di-t-amylphenoxybutanoyl group, arylcarbonyl groups such as benzoyl group, 3-pentadecyloxybenzoyl group, p-chlorobenzoyl group, and the like.

The sulfonyl group represented by R includes alkylsulfonyl groups such as methylsulfonyl group, dodecylsulfonyl group, etc.; and arylsulfonyl groups such as benzenesulfonyl group, p-toluenesulfonyl group, etc.; and the like.

The sulfinyl group represented by R includes alkylsulfinyl groups such as ethylsulfinyl group, octylsulfinyl group, 3-phenoxybutylsulfinyl group, etc.; and arylsulfinyl groups such as phenylsulfinyl group, m-pentadecylphenylsulfinyl group, etc.; and the like.

The phosphonyl group represented by R includes alkyl phosphonyl groups such as butyloctylphosphonyl group; alkoxyphophonyl groups such as octyloxyphosphonyl group; aryloxyphosphonyl groups such as phenoxyphosphonyl group; arylphosphonyl groups such as phenylphosphonyl group; and the like.

The carbamoyl group represented by R is allowed to have a substituent such as an alkyl or aryl (preferably phenyl) group and includes, e.g., N-methylcarbamoyl group, N,N-dibutylcarbamoyl group, N-(2-pentadecyloctylethyl)carbamoyl group, N-ethyl-N-dodecylcarbamoyl group, N-3-(2,4-di-t-amylphenoxy)-propylcarbamoyl group, and the like.

The sulfamoyl group represented by R is allowed to have a substituent such as an alkyl or aryl (preferably phenyl) group and includes, e.g., N-propylsulfamoyl group, N,N-diethylsulfamoyl group, N,N-diethylsulfamoyl group, N-(2-pentadecyloxyethyl)sulfamoyl group, N-ethyl-N-dodecylsulfamoyl group, N-phenylsulfamoyl group, and the like.

The spiro compound residue represented by R includes, e.g., spiro[3.3]heptane-1-yl and the like.

The cross-linked hydrocarbon compound residue represented by R includes, e.g., bicyclo[2.2.1]heptane-1-yl, tricyclo[3.3.1.1$^{3'7}$]decane-1-yl, 7,7-dimethyl-bicyclo[2.2.1]heptane-1-yl, and the like.

The alkoxy group represented by R is allowed to be substited by one mentioned as the substituent to the foregoing alkyl group and includes, e.g., methoxy group, propoxy group, 2-ethoxyethoxy group, pentadecyloxy group, 2-dodecyloxyethoxy group, phenethyloxyethoxy group, and the like.

The aryloxy group represented by R is desirable to be phenyloxy, and the aryl nucleus thereof is allowed to be substituted by one mentioned as a substituent or atom to the foregoing aryl group and includes, e.g., phenoxy group, p-t-butylphenoxy group, m-pentadecylphenoxy, and the like.

The heterocyclic oxy group represented by R is desirable to be one having a five- to seven-member heterocyclic ring, which is allowed to have further a substituent, and includes, e.g., 3,4,5,6-tetrahydropyranyl-2-oxy group, 1-phenyltetrazole-5-oxy group, and the like.

The siloxy group represented by R is allowed to have further a substituent such as an alkyl group, and includes, e.g., trimethylsiloxy group, dimethylbutylsiloxy group, and the like.

The acyloxy group represented by R includes, e.g., alkylcarbonyloxy groups, arylcarbonyloxy groups, etc., which may have further a substituent, and, to be more concrete, the group includes acetyloxy group, α-chloroacetyloxy group, benzoyloxy group, and the like.

The carbamoyloxy group represented by R is allowed to have a substituent such as an alkyl or aryl group, and includes, e.g., N-ethylcarbamoyloxy group, N,N-diethylcarbamoyloxy group, N-phenylcarbamoyloxy group, and the like.

The amino group represented by R is allowed to be substituted by an alkyl group, aryl group (preferaby phenyl group), etc., and includes, e.g., ethylamino group, anilino group, m-chloroanilino group, 3-pentadecyloxycarbonylanilino group, 2-chloro-5-hexadecaneamidoanilino group, and the like.

The acylamino group represented by R includes alkylcarbonylamino groups, arylcarbonylamino groups (preferably phenylcarbonylamino group), etc., which may be allowed to have a substituent, and, to be more concrete, the group includes acetamido group, α-ethylpropaneamido group, N-phenylacetamido group, dodecaneamido group, 2,4-di-t-amylphenoxyacetamido group, α-3-t-butyl-4-hydroxyphenoxybutaneamido group, and the like.

The sulfonamido group represented by R includes alkylsulfonylamino groups, arylsulfonylamino groups, etc., which may be allowed to have a substituent, and, to be more concrete, includes methylsulfonylamino group, pentadecylsulfonylamino group, benzenesulfonamido group, p-toluenesulfonamido group, 2-methoxy-5-t-amylbenzenesulfonamido group, and the like.

The imido group represented by R is allowed to be in either the open chain form or the ring form and to have a substituent, and includes, e.g., succinic acid imido group, 3-heptadecylsuccinic acid imido group, phthalic acid imido group, glutaric acid imido group, and the like.

The ureido group represented by R is allowed to have a substituent such as an alkyl group, an aryl group (preferably phenyl group), etc., and includes, e.g., N-ethylureido group, N-ethyl-N-decylureido group, N-phenylureido group, N-p-tolylureido group, and the like.

The sulfamoylamino group represented by R is allowed to have a substituent such as an alkyl group, an aryl group (preferably phenyl group), etc., and includes, e.g., N,N-dibutylsulfamoylamino group, N-methylsulfamoylamino group, N-phenylsulfamoylamino group, and the like.

The alkoxycarbonylamino group represented by R is allowed to have further a substituent, and includes, e.g., methoxycarbonylamino group, methoxyethoxycarbonylamino group, octadecyloxycarbonylamino group, and the like.

The aryloxycarbonylamino group represented by R is allowed to have a substituent, and includes, e.g., phenoxycarbonylamino group, 4-methylphenoxycarbonylamino group, and the like.

The alkoxycarbonylamino group is allowed to have further a substituent, and includes, e.g., methoxycarbonyl group, butyloxycarbonyl group, dodecyloxycarbonyl group, octadecylcarbonyl group, ethoxymethoxycarbonyloxy group, benzyloxycarbonyl group, and the like.

The aryloxycarbonyl group represented by R is allowed to have further a substituent, and includes, e.g., phenoxycarbonyl group, p-chlorophenoxycarbonyl group, m-pentadecyloxyphenoxycarbonyl group, and the like.

The alkylthio group represented by R is allowed to have further a substituent, and includes, e.g., ethylthio group, dodecylthio group, octadecylthio group, phenethylthio group, 3-phenoxypropylthio group, and the like.

The arylthio group represented by R is desirable to be phenylthio group, which is allowed to have further a substituent, and includes, e.g., phenylthio group, p-methoxyphenylthio group, 2-t-octylphenylthio group, 3-octadecylphenylthio group, 2-carboxyphenylthio group, p-acetaminophenylthio group, and the like.

The heterocyclic thio group represented by R is desirable to be a five- to seven-member heterocyclic thio group, which may have further a condensed ring and also a substituent, and includes, e.g., 2-pyridylthio group, 2-benzothiazolylthio group, 2,4-diphenoxy-1,3,5-triazole-6-thio group, and the like.

The substituent represented by R that can be split off as a result of the reaction with the oxidized product of a color developing agent includes, e.g., those groups which substitute through a carbon atom, an oxygen atom, a sulfur atom or a nitrogen atom aside from a halogen atom (chlorine, bromine, fluorine, etc.).

The group which substitues through a carbon atom includes, in addition to a carboxy group, e.g., those groups having the formula:

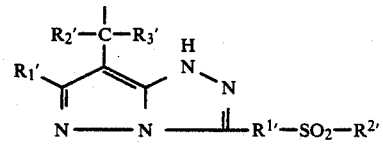

(wherein $R_1'$, $R^{1'}$ and $R^{2'}$ are are the same as the foregoing R, $R^1$ and $R^2$, respectively, and $R_2'$ and $R_3'$ each is a hydrogen atom, an aryl group, an alkyl group or a heterocyclic group), hydroxylethyl group, triphenylmethyl group, and the like.

The group which substitutes through an oxygen atom includes, e.g., alkoxy groups, aryloxy groups, heterocyclic oxy groups, acyloxy groups, sulfonyloxy groups, alkoxycarbonyloxy groups, aryloxycarbonyloxy groups, alkyloxalyloxy groups, alkoxyoxalyloxy groups, and the like.

The alkoxy group may be allowed to have further a sub stituent, and includes, e.g., ethoxy group, 2-phenoxyethoxy group, 2-cyanoethoxy group, phenethyloxy group, p-chlorobenzyloxy group, and the like.

The aryloxy group is desirable to be phenoxy, of which the aryl group may be allowed to have futher a substituent, and includes phenoxy group, 3-methylphenoxy group, 4-methanesulfonamidophenoxy group, 4-[α-(3'-pentadecylphenoxy)butaneamido]phenoxy group, hexydecylcarbamoylmethoxy group, 4-cyanophenoxy group, 4-methanesulfonylphenoxy group, 1-naphthyloxy group, p-methoxyphenoxy group, and the like.

The heterocyclic oxy group is desirable to be a five- to seven-member heterocyclic oxy group, which may be a condensed ring and may also have a substituent, and includes 1-phenyltetrazolyloxy group, 2-benzothiazolyloxy group, and the like.

The acyloxy group includes alkylcarbonyloxy groups such as, e.g., acetoxy group, butanoloxy group, etc., alkenylcarbonyloxy groups such as cinnamoyloxy group, etc., and arylcarbonyloxy groups such as benzoyloxy group, etc.

The sulfonyloxy group includes, e.g., butansulfonyloxy group, methanesulfonyloxy group, and the like.

The alkoxycarbonyloxy group includes, e.g., ethoxycarbonyloxy group, benzyloxycarbonyloxy group, and the like.

The aryloxycarbonyl group includes phenoxycarbonyloxy group, and the like.

The alkyloxalyloxy group includes, e.g., methyloxalyloxy group, and the like.

The alkoxyoxalyloxy group includes ethoxyoxalyloxy group, and the like.

Those groups which substitute through a sulfur atom include, e.g., alkylthio group, arylthio group, heterocyclic thio group, alkyloxythiocarbonylthio group, and the like.

The alkylthio group includes butylthio group, 2-cyanoethylthio group, phenethylthio group, benzylthio group, and the like.

The arylthio group includes phenylthio group, 4-methanesulfonamidophenylthio group, 4-dodecylphenethylthio group, 4-nonafluoropentaneamidophenethylthio group, 4-carboxyphenylthio group, 2-ethoxy-5-t-butylphenylthio group, and the like.

The heterocyclic thio group includes, e.g., 1-phenyl-1,2,3,4-tetrazolyl-5-thio goup, 2-benzothiazolylthio group, and the like.

The alkyloxythiocarbonylthio group includes dodecyloxythiocarbonylthio group, and the like.

The foregoing group substituting through a nitrogen atom includes, for example, those having the general formula:

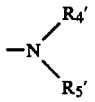

wherein $R_4'$ and $R_5'$ each is a hydrogen atom, an alkyl group, an aryl group, a heterocyclic group, a sulfamoyl group, a carbamoyl group, an acyl group, a sulfamoyl group or an aryloxycarbonyl group, provided that the $R_4'$ and the $R_5'$ may be combined to form a heterocyclic ring, and each need not be a hydrogen atom simultaneously.

The alkyl group may be in either the straight-chain form or the branched-chain form, and preferably one having from 1 to 22 carbon atoms. And the alkyl group may have a substituent including, e.g., aryl, alkoxy, aryloxy, alkylthio, arylthio, alkylamino, arylamino, acylamino, sulfonamido, imino, acyl, alkylsulfonyl, arylsulfonyl, carbamoyl, sulfamoyl, alkoxycarbonyl, aryloxycarbonyl, alkyloxycarbonylamino, aryloxycarbonylamino, hydroxyl, carboxyl and cyano groups and halogen atoms. Concrete examples of the alkyl group include, e.g., ethyl, hexyl, 2-ethylhexyl and 2-chloroethyl groups.

The aryl group represented by $R_4'$ or $R_5'$ is desirable to be one having from 6 to 32 carbon atoms, and to be particularly preferably a phenyl or naphthyl group. The arylk group is allowed to have a substituent which includes those quoted as the substituent to the above alkyl group represented by $R_4'$ or $R_5'$ and alkyl groups.

Examples of the aryl group include, e.g., phenyl group, 1-naphthyl group and 4-methylsulfonylphenyl group.

The heterocyclic group represented by $R_4'$ or $R_5'$ is desirable to be a five- or six-member ring, and is allowed to be a condensed ring, and also to have a substituent, and includes, e.g., 2-furyl group, 2-quinoly group, 2-pyrimidyl group, 2-benzothiazolyl group, 2-pyridyl group, and the like.

The sulfamoyl group represented by $R_4'$ or $R_5'$ includes N-alkylsulfamoyl group, N,N-dialkylsulfamoyl group, N-arylsulfamoyl group, N,N-diarylsulfamoyl group, and the like, of which the alkyl and aryl groups each may have the same substituent as defined in the foregoing alkyl and aryl group. Examples of the sulfamoyl group includes, e.g., N,N-diethylsulfamoyl group, N-methylsulfamoyl group, N-dodecylsulfamoyl group, N-p-tolysulfamoyl group, and the like.

The carbamoyl group represented by $R_4'$ or $R_5'$ includes N-alkylcarbamoyl group, N,N-dialkylcarbamoyl group, N-arylcarbamoyl group, N,N-diarylcarbamoyl group, and the like, of which the alkyl and aryl groups each may have a substituent as defined in the foregoing alkyl and aryl groups. Examples of the carbamoyl group includes N,N-diethylcarbamoyl group, N-methylcarbamoyl group, N-dodecylcarbamoyl group, N-p-cyanophenylcarbamoyl group, N-p-tolylcarbamoyl group, and the like.

The acyl group represented by $R_4'$ or $R_5'$ includes, e.g., alkylcarbonyl groups, arylcarbonyl groups, and heterocyclic carbonyl groups, of which the alkyl, aryl and heterocyclic groups each may have a substituent. Examples of the acyl group include, e.g., hexafluorobutanoyl group, 2,3,4,5,6-pentafluorobenzoyl group, acetyl group, benzoyl group, naphthoyl group, 2-furylcarbonyl group, and the like.

The sulfonyl group represented by $R_4'$ or $R_5'$ includes alkylsulfonyl groups, arylsulfonyl groups and heterocyclic sulfonyl groups, which each may have a substituent, and, to be more concrete, includes, e.g., ethanesulfonyl group, benzenesulfonyl group, octanesulfonyl group, naphthalenesulfonyl group, p-chlorobenzenesulfonyl group, and the like.

The aryloxycarbonyl group represented by $R_4'$ or $R_5'$ may have the same substituent as defined in the foregoing alkyl group, and includes phenoxycarbonyl group, and the like.

The alkoxycarbonyl group represented by $R_4'$ or $R_5'$ may have the same substituent as defined in the foregoing alkyl group, and includes methoxycarbonyl group, dodecyloxycarbonyl group, benzyloxycarbonyl group, and the like.

The heterocyclic ring formed by the combination of $R_4'$ or $R_5'$ is desirable to be a five- or six-member ring; may be either saturated or unsaturated; may be either aromatic or nonaromatic; and may be a condensed ring. The heterocyclic group includes, e.g., N-phthalimido group, N-succinic acid imido group, 4-N-urazolyl group, 1-N-hydantoinyl group, 3-N-2,4-dioxooxazolidinyl group, 2-N-1,1-dioxo-3-(2H)-oxo-1,2-benzothiazolyl group, 1-pyrrolyl group, 1-pyrrolidinyl group, 1-pyrazolyl group, 1-pyrazolidinyl group, 1-piperidinyl group, 1-pyrrolinyl group, 1-imidazolyl group, 1-imidazolinyl group, 1-indolyl group, 1-isoindolinyl group, 2-isoindolyl group, 2-isoindolinyl group, 1-benzotriazlyl group, 1-benzoimidazolyl group, 1-(1,2,4-triazolyl) group, 1-(1,2,3-triazolyl) group, 1-(1,2,3-triazolyl) group, 1-(1,2,3,4-tetrazolyl) group, N-morpholinyl group, 1,2,3,4-tetrahydroquinolyl group, 2-oxo-1-pyrrolidinyl group, 2-1H-pyridone group, phthaladione group, 2-oxo-1-piperidinyl group, and the like. These heterocyclic groups each may be substituted by a substituent such as an alkyl, aryl, alkyloxy, aryloxy, acyl, sulfonyl, alkylamino, arylamino, acylamino, sulfonamino, carbamoyl, sulfamoyl, alkylthio, arylthio, ureido, alkoxycarbonyl, aryloxycarbonyl, imido, nitro, cyano, or carboxyl group, or a halogen atom, or the like.

And in the foregoing Formula [II] the R is desirable to meet the following Requirement 1, more preferably the following Requirements 1 and 2, and most preferably the following Requirements 1, 2 and 3;

Requirement 1: The closest atom directly bounding to the heterocyclic ring shall be a carbon atom.

Requirement 2: One hydrogen atom alone or none shall be bonded to the carbon atom.

Requirement 3: The combination of the carbon atom with an adjacent atom shall be made by a single bond.

The most preferred as the above R are those having the following Formula [III]:

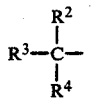

wherein $R_2$, $R_3$ and $R_4$ each represents a hydrogen atom, a halogen atom, an alkyl, cycloalkyl, alkenyl, cycloalkenyl, alkinyl, aryl, heterocyclic, acyl, sulfonyl, sulfinyl, phosphonyl, carbamoyl, sulfamoyl, cyano, spiro compound residue, cross-linked hydrocarbon compound residue, alkoxy, aryloxy, heterocyclic oxy, siloxy, acyloxy, carbamoyloxy, amino, acylamino, sulfonamido, imido, ureido, sulfamoylamino, alkoxycarbonylamino, aryloxycarbonylamino, alkoxycarbonyl, aryloxycarbonyl, alkylthio, arylthio or heterocyclic thio group, provided that at least two of the $R_2$, $R_3$ and $R_4$ are not hydrogen.

Two of the foregoing $R_2$, $R_3$ and $R_4$; for example, $R_2$ and $R_3$, may be combined to form a saturated or unsaturated ring (such as, e.g., cycloalkane, cycloalkene, heterocyclic ring), and further to the ring may be combined $R_4$ to constitute a cross-linked hydrocarbon compound residue.

These groups represented by $R_2$ through $R_4$ each may have a substituent, and concrete examples of these groups represented by $R_2$ through $R_4$ and of the substituents thereto are the same as those defined in the R of the foregoing Formula [II].

Also, examples of the ring formed by the combination of $R_2$ with $R_3$ and of the cross-linked hydrocarbon compound residue formed by $R_2$ through $R_4$ and also of those substituents which the above may have include the cycloalkyl, cycloalkenyl and heterocyclic groups and the substituents thereto quoted as the examples for the R of the foregoing Formula [II].

The preferred cases of Formula [III] are where (i) two of $R_2$ through $R_4$ are each an alkyl group, and (ii) one of $R_2$ through $R_4$, for example, $R_4$, is a hydrogen atom, and the other two, $R_2$ and $R_3$, are combined to form a cycloalkyl along with the closest carbon atom.

Further, the most preferred in the (i) is where two of $R_2$ through $R_4$ are each an alkyl group and the other one is a hydrogen atom or an alkyl group.

The alkyl and cycloalkyl herein each may be allowed to have a substituent, and examples of the alkyl, cycloalkyl and substituents thereto include those cited as the examples of the alkyl, cycloalkyl and substituents thereto for the R of the foregoing Formula [II].

The following are examples of the 1H—[3,2-C]—S—triazole-type magenta couplers to be used in the present invention, but this invention is not limited to and by the examples.

Exemplified Magenta Couplers:

(1)

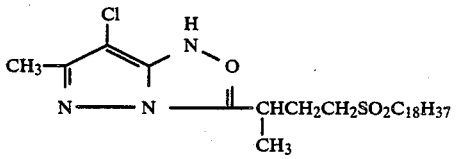

(2)

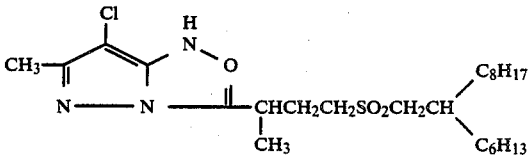

(3)

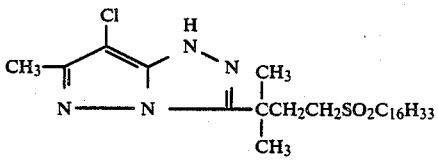

(4)

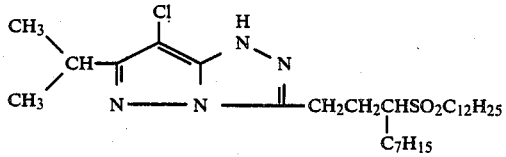

-continued
Exemplified Magenta Couplers:
(5)
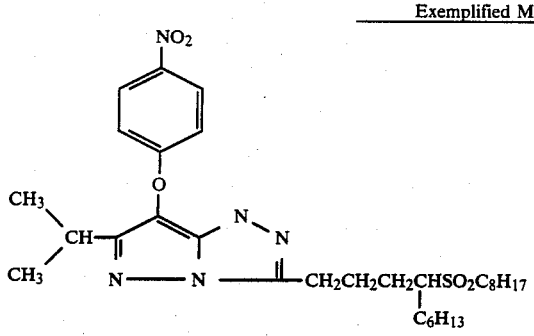
(6)
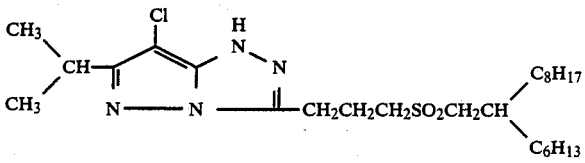
(7)
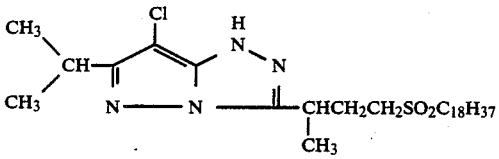
(8)
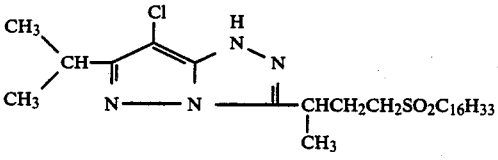
(9)
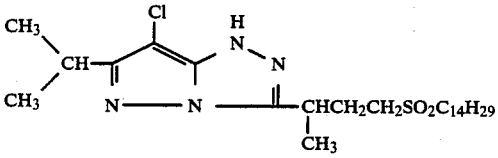
(10)
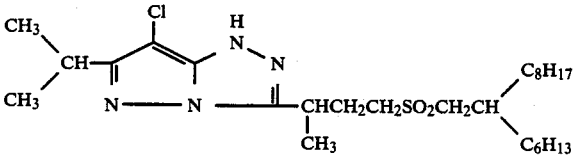
(11)
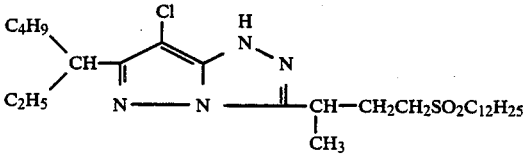
(12)
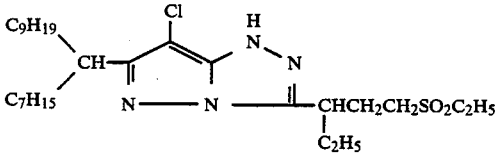
(13)
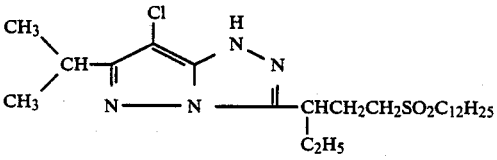

-continued
Exemplified Magenta Couplers:
(14)
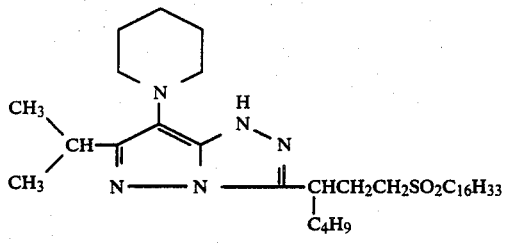
(15)
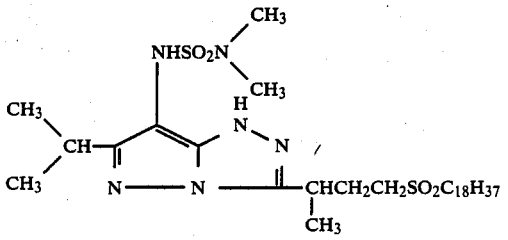
(16)
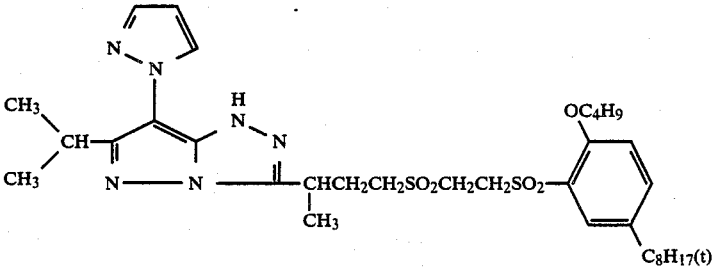
(17)
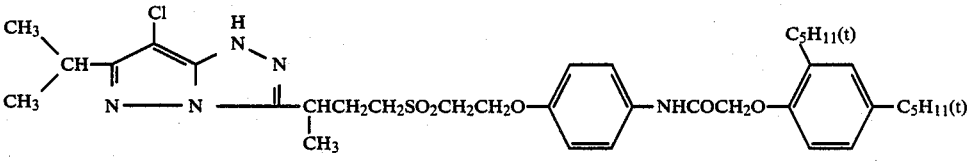
(18)
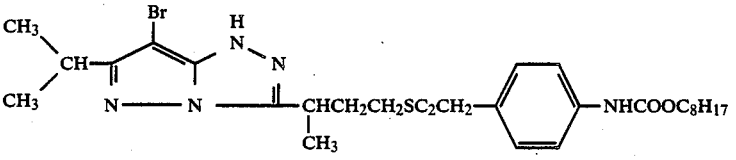
(19)
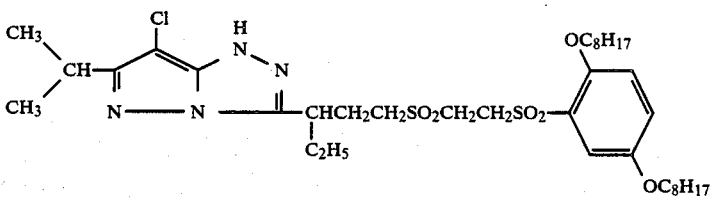
(20)
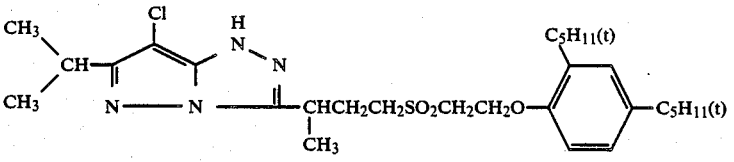

-continued
Exemplified Magenta Couplers:
(21)
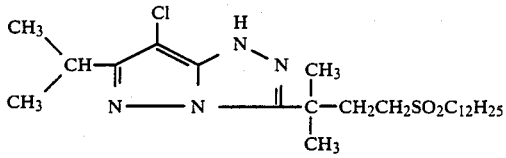
(22)
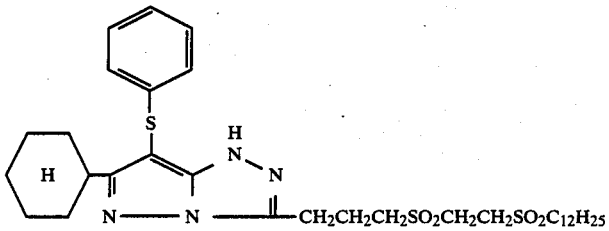
(23)
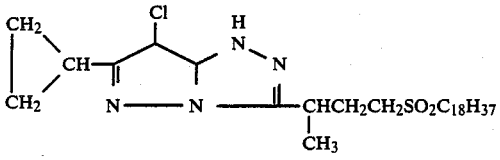
(24)
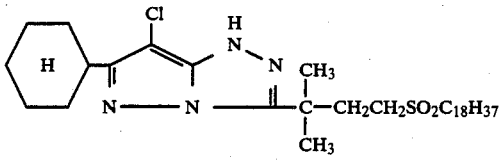
(25)
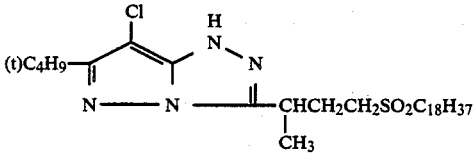
(26)
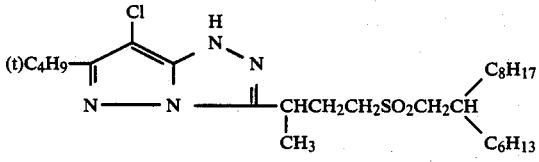
(27)
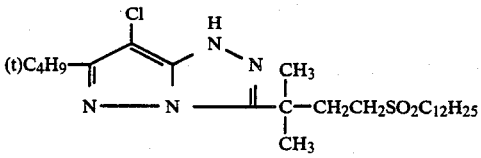
(28)
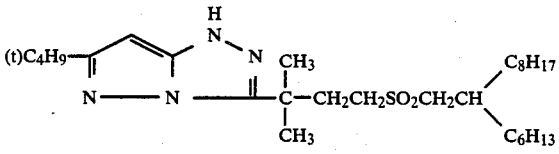
(29)
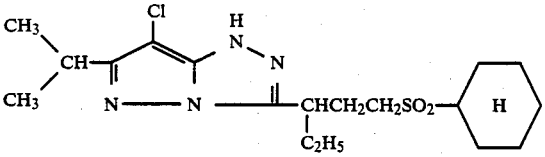

-continued
Exemplified Magenta Couplers:
(30)
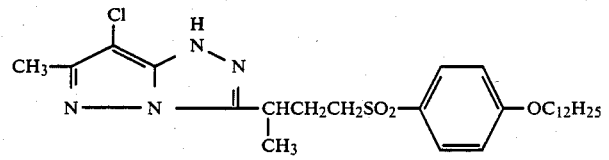
(31)
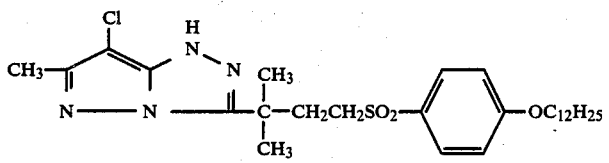
(32)
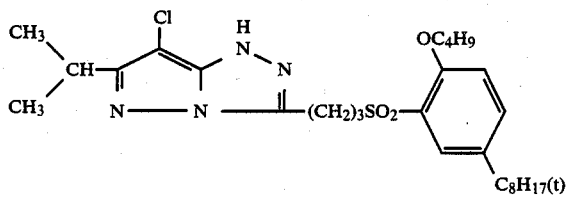
(33)
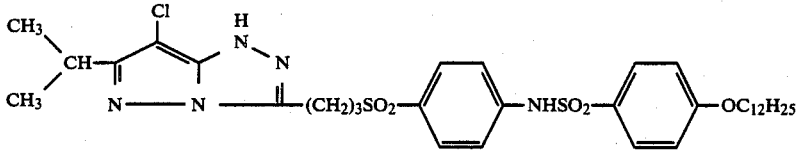
(34)
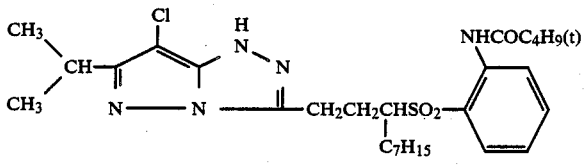
(35)
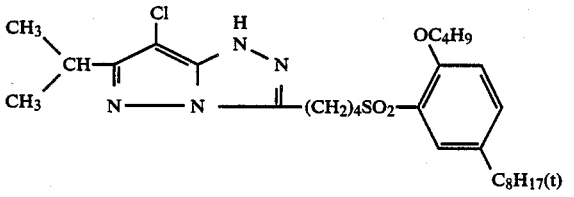
(36)
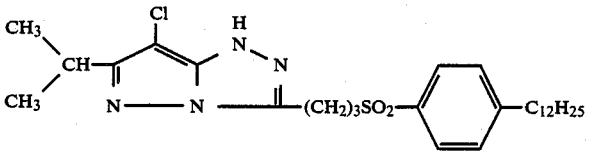
(37)
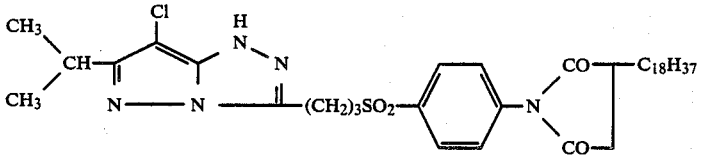
(38)
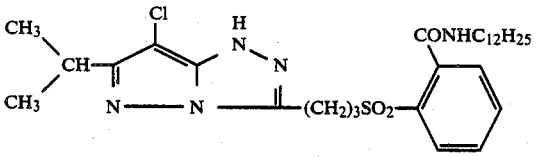

-continued
Exemplified Magenta Couplers:
(39)
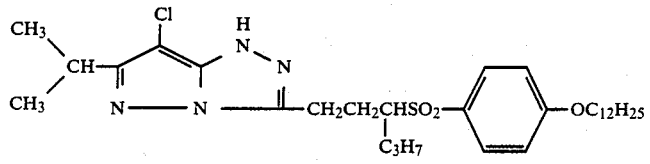
(40)
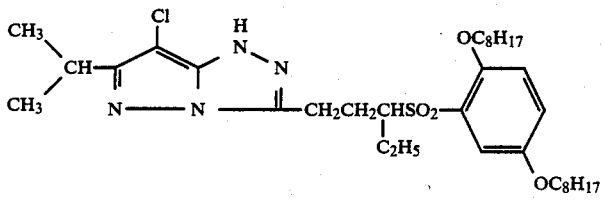
(45)
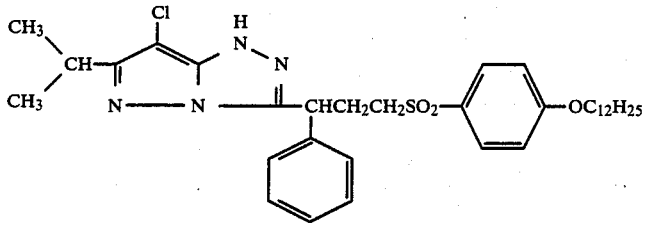
(46)
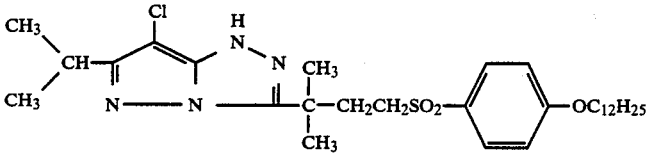
(47)
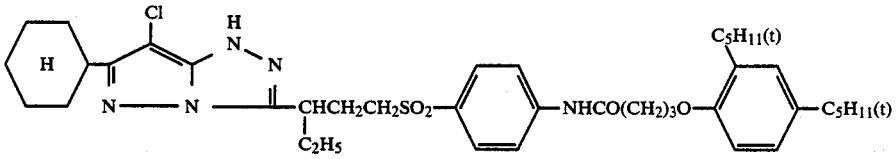
(48)
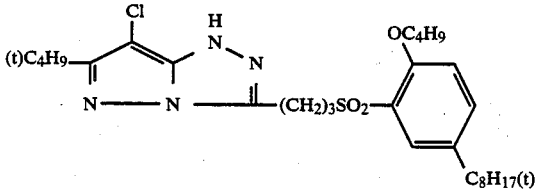
(49)
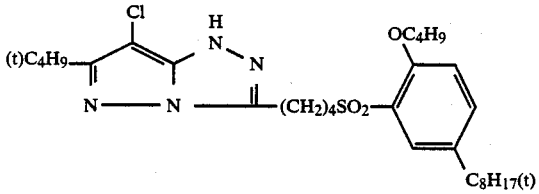
(50)
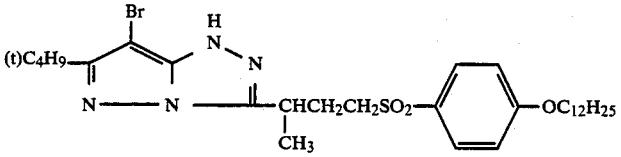

-continued

Exemplified Magenta Couplers:

(51)

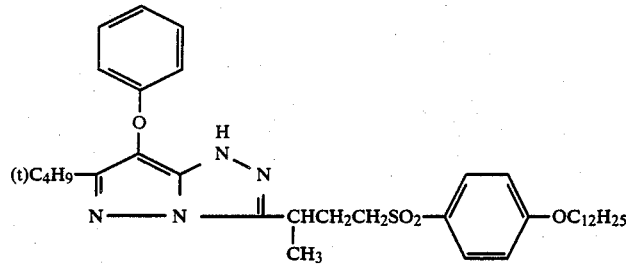

(52)

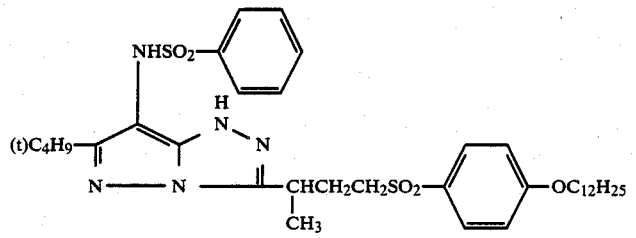

(53)

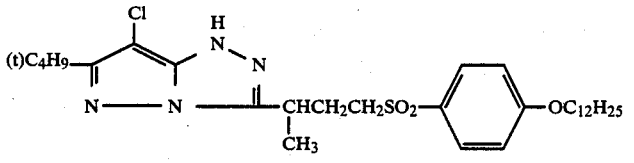

(54)

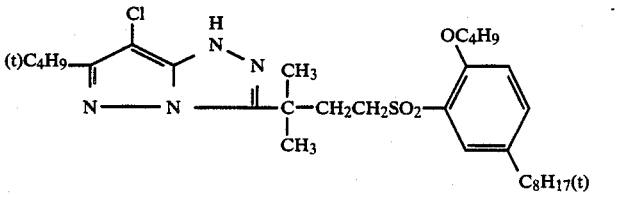

(55)

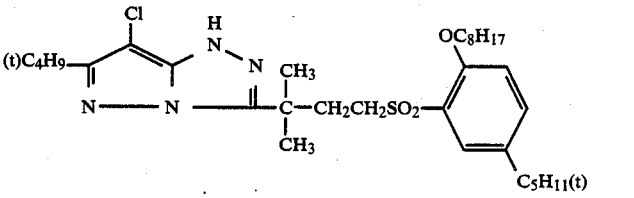

(56)

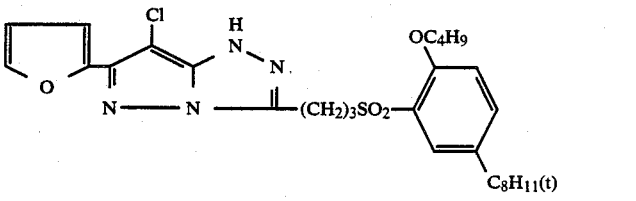

Syntheses of these exemplified couplers were carried out making reference to U.S. Pat. No. 3,725,067.

Any of these couplers of the present invention may be used in the quantity range of normally from $1\times10^{-3}$ mole to one mole, and preferably from $1\times10^{-2}$ mole to $8\times10^{-1}$ mole per mole of silver halide.

And any of the couplers of the present invention may be used in combination with any of different other magenta couplers.

Where the silver halide photographic light-sensitive material of the present invention is used as a multicolor photographic light-sensitive material, in addition to the coupler of the present invention, those yellow and cyan couplers normally used by those in the art may also be used in usual manner. And, if necessary, those colored couplers having color-compensation effect or those couplers releasing a development inhibitor in the course of development (DIR couplers) may also be used. Any of the above couplers, in order to satisfy the characteristics required for the light-sensitive material, may be used in combination of two or more different kinds thereof in the same layer, and may also be used in the manner that a single same compound thereof is incorporated into two or more different layers.

The cyan coupler and yellow coupler usable in the present invention include those phenol-type or naphthol-type cyan couplers and those acylacetamide-type or benzoylmethane-type yellow couplers, respectively.

These yellow couplers are described in, e.g., U.S. Pat. Nos. 2,778,658, 2,875,057, 2,908,573, 3,227,155, 3,227,550, 3,253,924, 3,265,506, 3,227,155, 3,341,331, 3,369,895, 3,384,657, 3,408,194, 3,415,652, 3,447,928, 3,551,155, 3,582,322, 3,725,072 and 3,894,875; West German OLS Patent Nos. 1,547,868, 2,057,941, 2,162,899, 2,163,812, 2,218,461, 2,219,917, 2,261,361 and 2,263,875.

These cyan couplers are described in, e.g., U.S. Pat. Nos. 2,369,929, 2,423,730, 2,434,272, 2,474,293, 2,698,794, 2,706,684, 2,772,162, 2,801,171, 2,895,826, 2,908,573, 3,034,892, 3,046,129, 3,227,550, 3,253,294, 3,311,476, 3,386,301, 3,419,390, 3,458,315, 3,476,563, 3,516,831, 3,560,212, 3,582,322, 3,583,971, 3,591,383, 3,619,196, 3,632,347, 3,652,286, 3,737,326, 3,758,308, 3,779,763, 3,839,044 and 3,880,661.

Regarding those metallic complexes having the foregoing Formulas [II], [III] and [IV] (hereinafter referred to generically as 'metallic complex(s) of this invention'), one of them may be used alone, or two or more of the respective compounds having the Formulas may be used, or one or more of the compounds represented by each Formula may be used in combination. Any of the above cases can sufficiently accomplish the objects of the present invention.

The $X^1$ and $X^2$ of the foregoing Formulas [II], [III] and [IV] may be either the same as or different from one another and each represents an oxygen atom, a sulfur atom, —$NR^7$— (wherein $R^7$ represents a hydrogen atom, an alkyl group (such as methyl, ethyl, n-propyl, i-propyl, n-butyl, t-butyl, i-butyl, benzyl, etc.), an aryl group (such as phenyl, tolyl, naphthyl, etc.), or a hydroxyl group, preferably an oxygen atom or a sulfur atom, and more preferably an oxygen atom.

The $X^3$ of Formula [IV] represents a hydroxyl group or a mercapto group, and preferably a hydroxyl group.

The Y of Formulas [II], [III] and [IV] (the two Ys present in Formula [IV] may be the same as or different from each other) represents an oxygen atom or a sulfur atom, and preferably a sulfur atom.

The $R^3$, $R^4$, $R^5$ and $R^6$ of Formulas [II], [III] and [IV] may be the same as or different from one another, and represents a hydrogen atom, a halogen atom (fluorine, chlorine, bromine or iodine), a cyano group, an alkyl group (such as methyl, ethyl, propyl, butyl, hexyl, octyl, dodecyl, hexadecyl or the like, which alkyl is allowed to be in the either straight-chain or branched-chain form) which is combined with a carbon atom directly or through a divalent linkage group [such as —O—, —S—, —NH—, —$NR^7$— wherein $R^7$ ≠*is a monovalent group such as a hydroxyl group, an alkyl group (such as methyl, ethyl, n-propyl, i-propyl, n-butyl, t-butyl, i-butyl or the like), an aryl group (such as phenyl, tolyl, naphthyl or the like),* —*OCO*—, —*CO*—, —*NHCO*—, —*CONH*—, —*COO*—, —$SO_2NH$—, —$NHSO_2$—, —$SO_2$, or the like], an aryl group (such as phenyl, naphthyl etc.), a cycloalkyl group (such as cyclopentyl, cyclohexyl) or a heterocyclic group (such as pyridyl, imidazolyl, furyl, thienyl, pyrrolyl, pyrrolidinyl, quinolyl, morpholinyl, etc.). The group which is formed by, of these groups, the alkyl, aryl, cycloalkyl, or heterocyclic group, which is to be combined to a carbon atom through a divalent linkage group, along with the said linkage group, includes, e.g., alkoxy groups (straight-chain or branched-chain alkyloxy groups such as methoxy, ethoxy, n-butyloxy, octyloxy, etc.), alkoxycarbonyl groups (straight-chain or branched-chain alkyloxycarbonyl groups such as methoxycarbonyl, ethoxy carbonyl, n-hexadecyloxycarbonyl, etc.), alkylcarbonyl groups (straight-chain or branched-chain alkylcarbonyl groups such as acetyl, valeryl, stearoyl, etc.), arylcarbonyl groups (such as benzoyl), alkylamino groups (straight-chain or branched-chain alkylamino groups such as N-n-butylamino, N,N-di-n-butylamino, N,N-di-n-octylamino, etc.), alkylcarbamoyl groups straight-chain or branched-chain alkylcarbamoyl groups such as n-butylcarbamoyl group, n-dodecylcarbamoyl groups, etc.), alkylsulfamoyl groups (straight-chain or branched-chain alkylsulfamoyl groups such as n-butylsulfamoyl, n-dodecylsulfamoyl, etc.), alkylacylamino groups (straight-chain or branched-chain alkylcarbonylamino groups such as acetylamino, palmitoylamino, etc.), aryloxy groups (such as phenoxy, naphthoxy, etc.), aryloxycarbonyl groups (such as phenoxycarbonyl, naphthoxycarbonyl), arylamino groups (such as N-phenylamino, N-phenyl-N-methylamino), arylcarbamoyl groups (such as phenylcarbamoyl), arylsulfamoyl groups (such as phenylsulfamoyl), arylacylamino groups (such as benzoylamino), and the like.

Regarding the $R^3$, $R^4$, $R^5$ and $R^6$ of each of Formulas [II], [III] and [IV], at least one of the $R^3$—$R^4$ and $R^5$—$R^6$ combinations may be combined with each other along with carbon atoms to be bonded to thereby form a five- or six-member ring. In this instance, the five- or six-member ring formed by at least one of the $R^3$—$R^4$ and $R^5$—$R^6$ combinations along with the carbon atomes to be bonded includes at least one unsaturated bonding-having hydrocarbon rings, heterocyclic rings, (e.g., nitrogen-containing five- or six-member heterocyclic rings), etc., such as, for example, cyclopentene ring, cyclohexene ring, benzene ring (including condensed benzene rings; i.e., naphthalene ring and anthracene ring), and the like. Where any of these five- or six-member rings has a substituent, the substituent includes, for example, halogen atoms (fluorine, chlorine, bromine, iodine), cyano group, alkyl groups (straight-chain or branched-chain alkyl groups having from 1 to 20 carbon atoms such as methyl, ethyl, n-propyl, n-butyl, n-octyl, t-octyl, n-hexadecyl, etc.), aryl groups (such as phenyl, naphthyl), alkoxy groups (straight-chain or branched-chain alkyloxy group such as methoxy, n-butoxy, t-butoxy, etc.), aryloxy groups (such as phenoxy), alkoxycarbonyl groups (straight-chain or branched-chain alkyloxycarbonyl groups such as n-pentyloxycarbonyl, t-pentyloxycarbonyl, n-octyloxycarbonyl, t-octyloxycarbonyl, etc.), aryloxycarbonyl groups (such as phenoxycarbonyl), acyl groups (straight-chain or branched-chain alkylcarbonyl groups such as acetyl, stearoyl, etc.), acylamino groups (straight-chain or branched-chain alkylcarbonylamino groups such as acetamido, etc., arylcarbonylamino groups such as benzoylamino, etc.), arylamino groups (such as phenylamino), alkylamino groups (straight-chain or branched-chain alkylamino groups such as N-n-butylamino, N,N-diethylamino, etc.), carbamoyl groups (straight-chain or branched-chain alkylcarbamoyl groups such as n-butylcarbamoyl, etc.), sulfamoyl groups (straight-chain or branched-chain alkylsulfamoyl groups such as N,N-di-n-butylsulfamoyl, N-n-dodecylsulfamoyl, etc.), sulfonamido groups (straight-chain or branched-chain alkylsulfonylamino groups such as methylsulfonylamino, etc., arylsulfonylamino groups such as phenylsulfonylamino, etc.), sulfonyl groups (straight-chain or branched-chain alkylsulfonyl groups such as mesyl, etc., arylsulfonyl groups such as tosyl, etc.), cycloalkyl groups (such as cyclohexyl), and the like.

Formula [II], Formula [III] and Formula [IV] each is preferably one selected from where the alkyl or aryl group represented by each of the $R^3$, $R^4$, $R^5$ and $R^6$ or one of the $R^3$—$R^4$ and $R^5$—$R^6$ combinations is combined with one another to form a five- or six-member ring along with carbon atoms, and more preferably one in the case where each of the $R^3$—$R^4$ and $R^5$—$R^6$ combinations is combined to form a six-member ring along with the carbon atoms to be bonded, and most preferably one in the case where they form a benzene ring.

The M of each of Formulas [II], [III] and [IV] represents a metallic atom, preferably a transition metallic atom, and more preferably a nickel, copper, iron, cobalt, palladium, or platinum atom, and most preferably a nickel atom.

The compound coordinatable to the M represented by the $Z^0$ in Formula [III] is preferably an alkylamine having a straight-chain or branched-chain alkyl group, more preferably an alkylamin whose alkyl has from 2 to 36 carbon atoms in total, and most preferably a dialkylamine or trialkylamine whose alkyl has from 3 to 24 carbon atoms in total. Examples of the alkylamin include monoalkylamines such as butylamine, octylamine (such as t-octylamine), dodecylamine (such as n-dodecylamine), hexadecylamine, octanolamine, and the like; dialkylamines such as diethylamine, dibutylamine, dioctylamine, didodecylamine, diethanolamine, and the like; and trialkylamines such as triethylamine, tributylamine, trioctylamine, triethanolamine, tributanolamine, trioctanolamine, and the like.

The more preferred ones as the metallic complex of the present invention represented by the Formulas [II], [III] and [IV] are those metallic complexes having the following Formula [IIa], Formula [IIIa] and Formula [IVa]:

Formula [IIa]

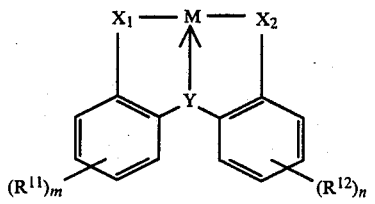

Formula [IIIa]

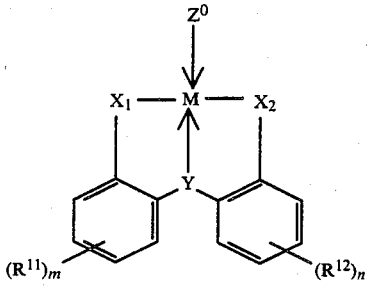

-continued

Formula [IVa]

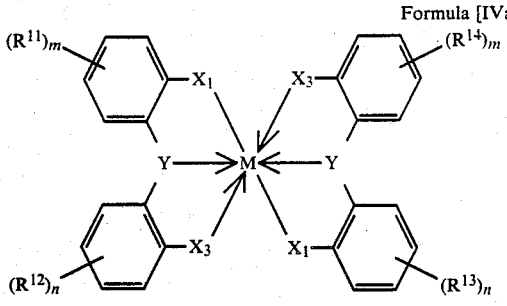

In Formulas [IIa], [IIIa] and [IVa], M, $X_1$, $X_2$, $X_3$, Y and $Z^0$ are as defined previously.

In Formulas [IIa], [IIIa] and [IVa], $R^{11}$, $R^{12}$, $R^{13}$ and $R^{14}$ each is an alkyl group (a straight-chain or branched-chain alkyl group such as methyl, ethyl, n-propyl, n-butyl, n-octyl, t-octyl, n-hexadecyl, etc.), an aryl group (such as phenyl, naphthyl, etc.), an alkoxy group (a straight-chain or branched-chain alkoxy group such as methoxy, n-butoxy, t-butoxy, etc.), an aryloxy group (such as phenoxy), an alkoxycarbonyl group (a straight-chain or branched-chain alkyloxycarbonyl group such as n-pentyloxycarbonyl, t-pentyloxycarbonyl, n-octyloxycarbonyl, t-octyloxycarbonyl, etc.), an aryloxycarbonyl (such as phenoxycarbonyl), an acyl group (a straight-chain or branched-chain alkylcarbonyl group such as acetyl, stearoyl, etc.), an acylamino group (a straight-chain or branched-chain alkylcarbonylamino group such as acetamido, an arylcarbonylamino group such as benzoylamino), an arylamino group (such as N-phenylamino), an alkylamino group (a straight-chain or branched-chain alkylamino group such as N-n-butylamino, N,N-diethylamino, etc.), a carbamoyl group (a straight-chain or branched-chain alkylcarbamoyl group such as n-butylcarbamoyl), sulfamoyl group (a straight-chain or branched-chain alkylsulfamoyl group such as N,N-di-n-butylsulfamoyl, N-n-dodecylsulfamoyl, etc.), a sulfonamido group (a straight-chain or branched-chain alkylsulfonylamino group such as methylsulfonylamino, an arylsulfonylamino group such as phenylsulfonylamino), a sulfonyl group (a straight-chain or branched-chain alkylsulfonyl group such as mesyl, an arylsulfonyl group such as tosyl), or an cycloalkyl group (such as cyclohexyl); and m and n each is an integer of from zero up to 4.

The more preferred ones of compounds having Formulas [IIa], [IIIa] and [IVa] are those having Formula [IIIa]. The most preferred ones among those compounds having Formula [IIIa] are represented by the following Formula [IIIb]:

Formula [IIIb]

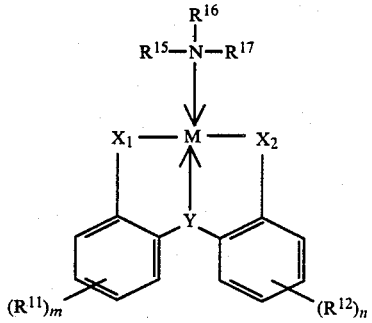

wherein M, $X_1$, $X_2$, Y, $R^{11}$, $R^{12}$, m and n are as defined previously; and $R^{15}$, $R^{16}$ and $R^{17}$ each represents a hydrogen atom, an alkyl group (such as butyl, octyl, stearyl, etc.), or an aryl group (such as phenyl, naphthyl, etc.), provided that each of at least two of $R^{15}$, $R^{16}$ and $R^{17}$ represents an alkyl or aryl group.

The following are typical examples of the metallic complexes of the present invention (hereinafter referred to as 'exemplified complex'), but the invention is not limited thereto.

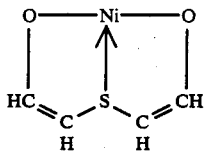

II-(1)

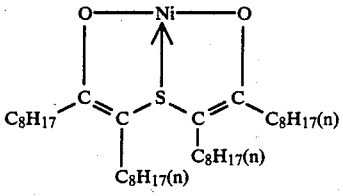

II-(2)

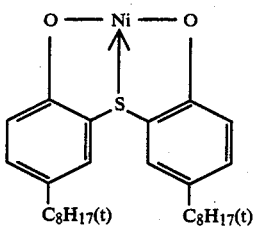

II-(3)

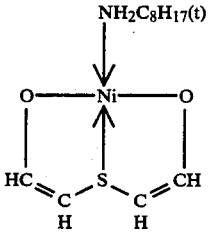

II-(4)

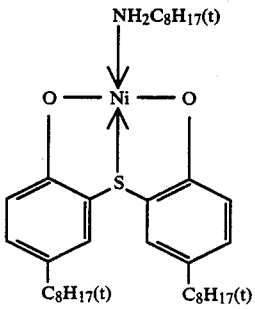

II-(5)

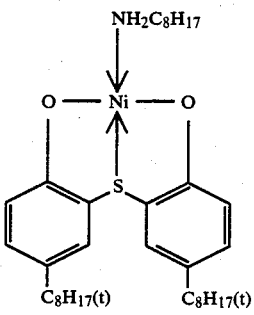

II-(6)

-continued
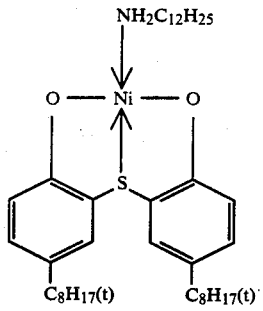
II-(7)
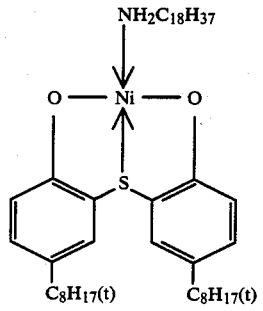
II-(8)
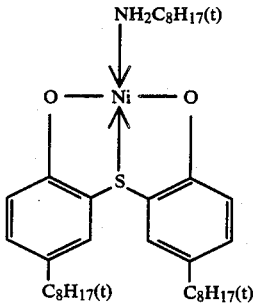
II-(9)
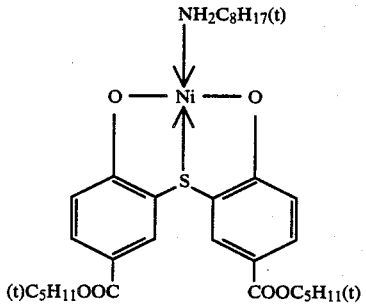
II-(10)
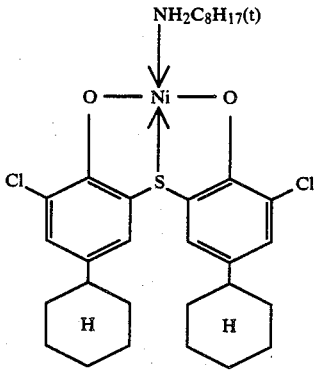
II-(11)

-continued
II-(12)
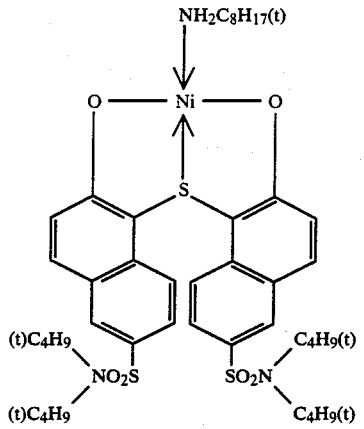
II-(13)
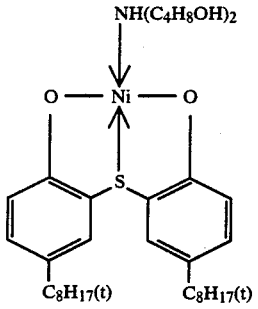
II-(14)
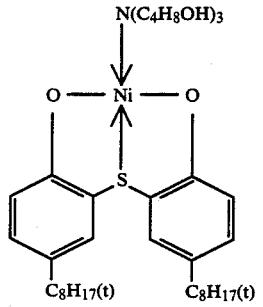
II-(15)
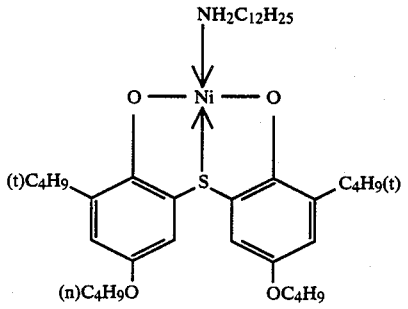
II-(16)
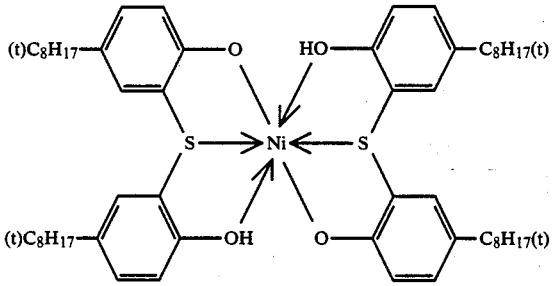

-continued
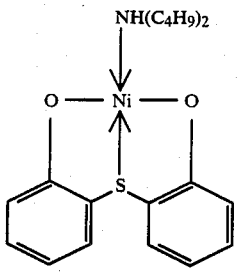
II-(17)
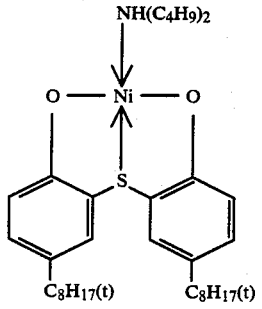
II-(18)
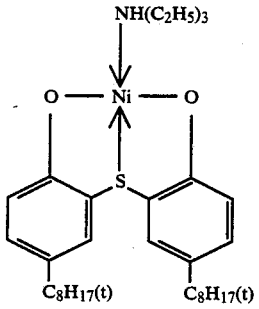
II-(19)
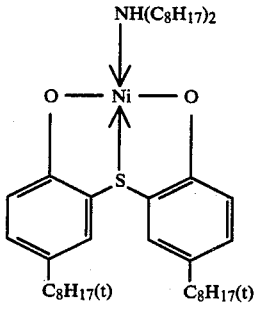
II-(20)
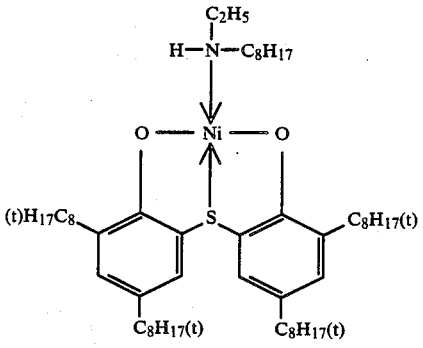
II-(21)

-continued
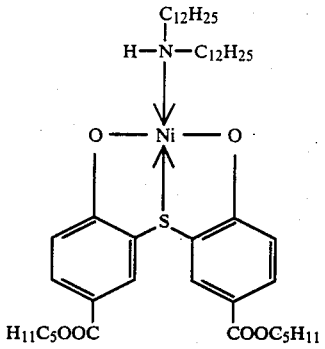
II-(22)
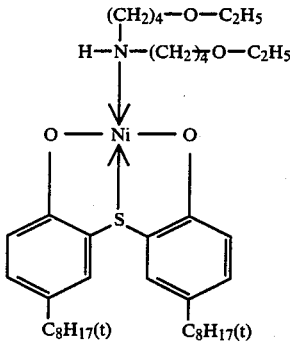
II-(23)
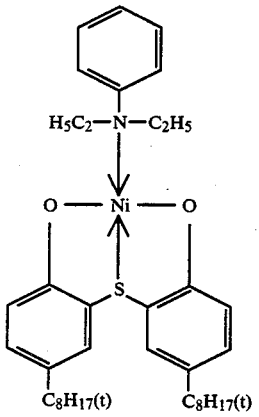
II-(24)
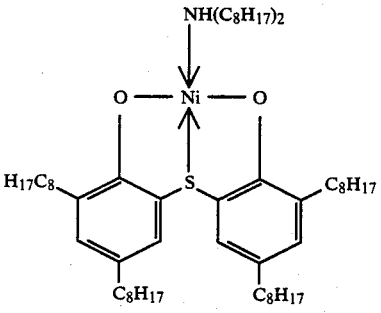
II-(25)

-continued
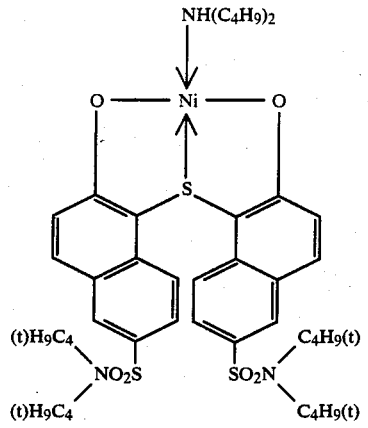
II-(26)
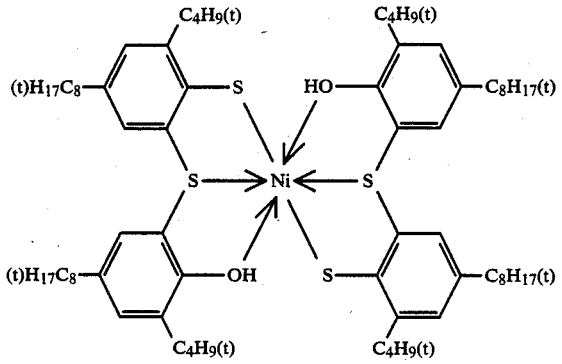
II-(27)
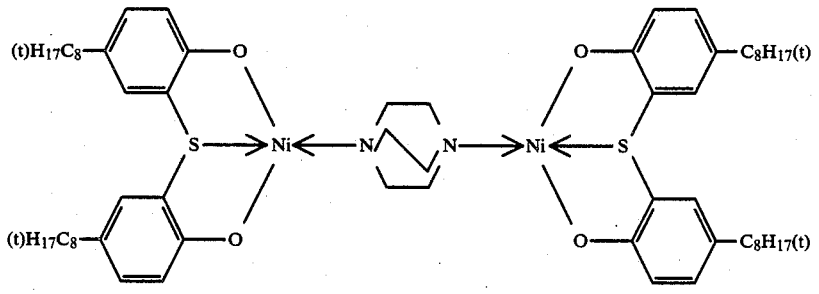
II-(28)
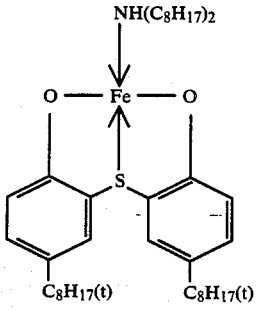
II-(29)

-continued

II-(30)

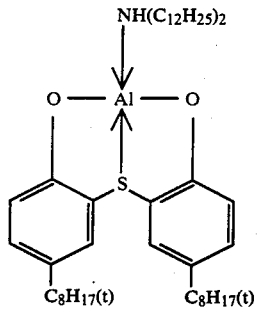

These complex compounds may be synthesized by those methods described in British Pat. No. 858,890, West German OLS Patent No. 2,042,652, and the like.

The complex of the present invention is desirable to be used in the quantity range of normally from 5 to 100% by weight of the coupler of the present invention, and more preferably from 10 to 50% by weight. And the complex of the present invention is desirable to be used in combination with the coupler of this invention in the same layer, and further desirable to be present along with the coupler in the same oil drop.

The metallic complex of the present invention may be used in combination with an oxidation inhibitor having the following formula:

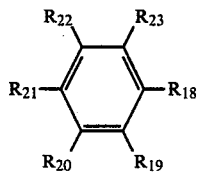

wherein $R_{18}$ is a hydrogen atom, an alkyl group, an aryl group or a heterocyclic group; $R_{19}$, $R_{20}$, $R_{21}$ and $R_{22}$ each is a hydrogen atom, a hydroxy group, an alkyl group, an aryl group, an alkoxy group or an acylamino group; and $R_{21}$ is an alkyl group, a hydroxy group, an aryl group or an alkoxy group; provided that the $R_{18}$ and $R_{19}$ may be closed to form a five- or six-member heterocyclic ring, and in that case, the $R_{21}$ represents a hydroxy group or an alkoxy group.

The $R_{18}$ abd $R_{19}$ may also be closed to form a methylenedioxy ring. And the $R_{20}$ and $R_{21}$ may also be closed to form a five-member hydrocarbon ring, and in that case, the $R_{18}$ represents an alkyl group, an aryl group or a heterocyclic group.

The following are examples of the above oxidation inhibitor, but the invention is not limited thereto.

1

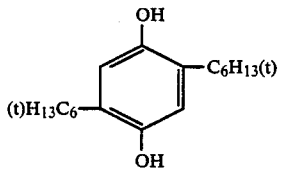

2

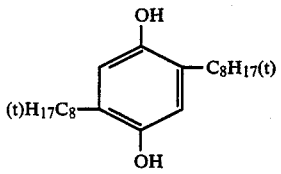

-continued

3

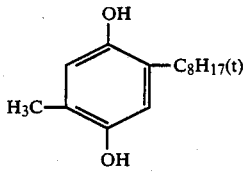

4

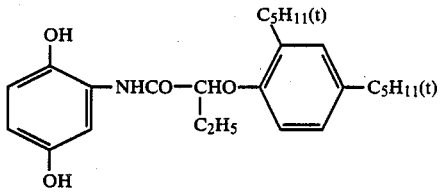

5

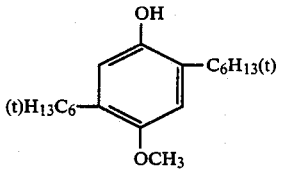

6

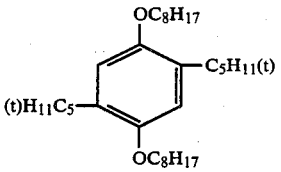

7

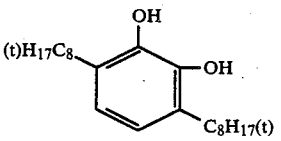

8

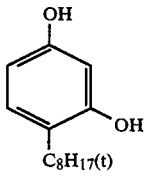

9

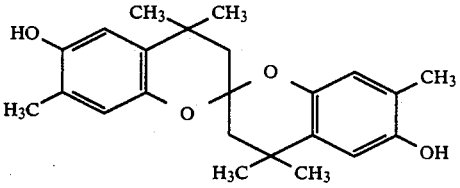

-continued

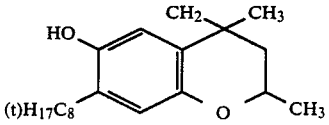

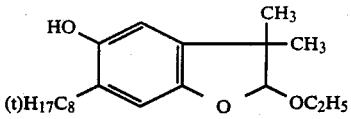

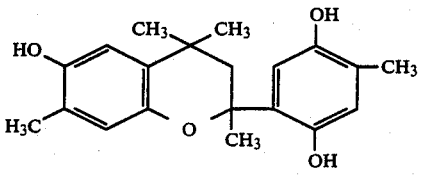

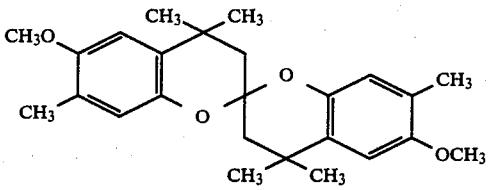

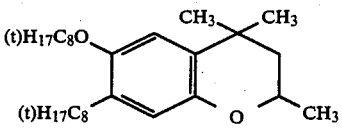

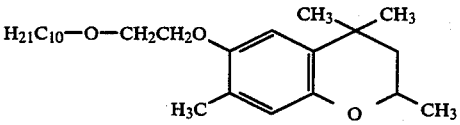

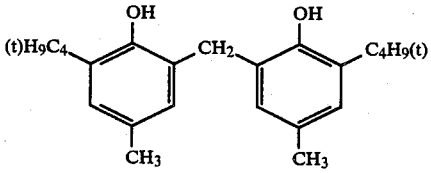

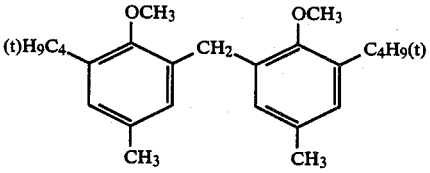

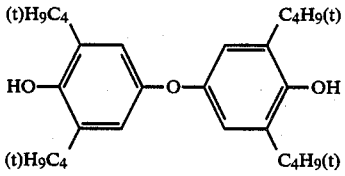

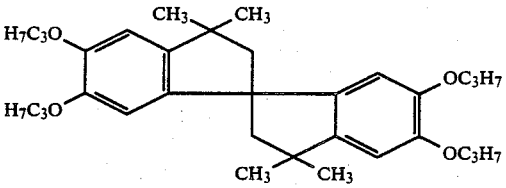

-continued

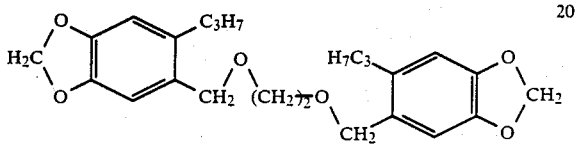

11

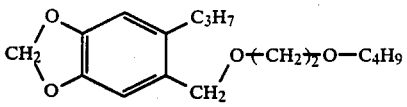

12

The silver halide photographic light-sensitive material of the present invention can be, for example, color negative or positive film, color photographic paper, or the like, and above all, when used as color photographic paper for use in direct appreciation, the effect of the present invention is advantageously displayed.

13 The silver halide photographic light-sensitive material of this invention including the color photographic paper may be for either monochromatic use or multicolor use. In the case of the silver halide photographic light-sensitive material for multicolor use, the light-sensitive material, in order to accomplish the subtractive color reproduction, is of a construction comprising a support having thereon an arbitrary number of sequentially coated silver halide emulsion layers containing usually photographic magenta, yellow and cyan couplers and non-light-sensitive layers, but the number of such emulsion layers and the sequence of coating the layers may be arbitrarily changed according to the preferential characteristic or purpose for which the light-sensitive material is used.

14 The silver halide for the silver halide emulsion used in the silver halide photographic light-sensitive material of the present invention (hereinafter called the silver halide emulsion of the invention) may be arbitrary one of those used in ordinary silver halide emulsions, such as silver bromide, silver iodobromide, silver iodochloride, silver chlorobromide, silver chloride, and the like.

Silver halide grains used in the silver halide emulsion of the invention may be ones obtained by any of the acidic method, neutral method and ammoniacal method. The grain may be one grown at a time or one 17 obtained in the manner that a seed grain is once prepared, and it is then grown. The preparing method and growing method of the seed grain may be either the same or different.

The silver halide emulsion of the invention may be prepared either by mixing halide and silver ions simultaneously or by mixing either one into the other being already present. The silver halide crystal growth may 18 also be made, taking into account its critical growth rate, by sequentially adding halide and silver ions into a mixing pot with its inside pH and pAg controlled. Also, the silver halide composition of the grain may be varied by using the conversion method after the growth.

The grain size, grain form, grain size distribution and grain's growth rate of the silver halide grain may be 19 controlled by using at need a silver halide solvent in the course of preparing the silver halide emulsion of this invention.

The silver halide grain used in the silver halide emulsion of this invention may have thereinside and/or on the surface thereof a metallic ion by using in the course of the formation and/or growth of the grain a cadmium salt, zinc salt, lead salt, thalium salt, iridium salt or its complex salt, rhodium salt or its complex salt, or iron salt or its complex salt, and may also have thereinside and/or on the surface thereof a reduction sensitization nucleus by being place in an appropriate reductive atmosphere.

The silver halide emulsion of this invention may undergo a treatment of removal of its unnecessary soluble salts therefrom after completion of the growth of the silver halide grain or may remain containing the soluble salts. If the salts should be removed, the removal may be carried out in accordance with the method described in Research Disclosure 17643.

The silver halide grain used in the silver halide emulsion of this invention may be comprised either of homogeneous inside and outside layers or of heterogeneous layers.

The silver halide grain of the silver halide emulsion of this invention may be either of the type that a latent image is formed principally on the surface thereof or of the type that a latent image is formed principally thereinside.

The silver halide grain used in the silver halide emulsion of the present invention may be either in the regular crystal form or in the irregular crystal form such as in the spherical or plate form; may be used in any crystal form having an arbitrary [100] face-[111] face proportion, and also in the composite of these crystal forms; and may also be used in a mixture of various crystal forms-having grains.

The silver halide emulsion of the invention may be a mixture of separately prepared two or more different silver halide emulsions.

The silver halide emulsion of this invention may be chemically sensitized in usual manner; that is, the chemical sensitization may be carried out by using alone or in combination the sulfur sensitization method which uses a sulfur-containing compound or active gelatin reactive with a silver ion; the selenium sensitization method which uses a selenium compound; the reduction sensitization method which uses a reductive material; the noble-metallic sensitization method which uses a gold or other noble-metallic compound; and the like.

The silver halide emulsion of this invention may be optically sensitized to desired wavelength regions by using those dyes known as sensitizing dyes to those skilled in the art. Such sensitizing dyes may be used alone or in combination of two or more of them. Along with such sensitizing dyes a supersensitizing agent which is a dye in itself having no spectrally sensitizing ability or a compound not substantially absorbing visible rays and which serves to strengthen the sensitizing effect of such sensitizing dyes may be incorporated into the emulsion.

To the silver halide emulsion of this invention, for the purpose of preventing possible occurence of fog during the manufacture, storage, or processing of the light-sensitive material and/or of maintaining the photographic characteristics stable, may be added any of those compounds known as antifoggants or as stabilizers to those skilled in the art during the chemical ripening process and/or at the time of completion of the chemical ripening and/or during the period after completion of the chemical ripening up to the time of coating the silver halide emulsion.

Gelatin may be advantageously used as the binder (or protective colloid) of the silver halide emulsion of this invention, and, in addition, hydrophilic colloidal materials such as gelatin derivatives, graft polymers of gelatin with other high-molecular compounds, protein, sugar derivatives, cellulose derivatives, synthetic hydrophilic high-molecular materials such as homo- or copolymers may also be used.

The photographic emulsion layers or other hydrophilic colloidal layers of the light-sensitive material using the silver halide emulsion of this invention may be hardened by using alone or in combination hardening agents which function to cross-link the binder (or protective colloid)'s molecule to increase the strength of the layers. The hardening agent is desirable to be added to the layers in a quantity so enough for hardening the light-sensitive material that no addition of the hardening agent to the processing solution therefore is necessary. It is possible, however, to add the hardening agent to the solution.

For the purpose of increasing the plasticity of the silver halide emulsion layers and/or other hydrophilic colloidal layers of the light-sensitive material using the silver halide emulsion of this invention, a plasticizer may be added to the layers.

Into the photographic layers and/or other hydrophilic colloidal layers of the light-sensitive material using the silver halide emulsion of this invention, for the purpose of improving its dimensional stability, etc., may be incorporated a water-insoluble or less-soluble synthetic polymer-dispersed latex.

In the emulsion layers of the silver halide color photographic light-sensitive material of the present invention dye-forming couplers may be used which, in color development, effect the coupling reaction with the oxidized product of an aromatic primary amine developing agent (such as a p-phenylenediamine derivative, aminophenol derivative, etc.) to thereby form dyes. The dye-forming coupler is usually selected for each emulsion layer so as to form a dye that absorbs the light in a spectral region to which an emulsion layer is sensitive, and thus, an yellow dye-forming coupler is used for a blue light-sensitive emulsion layer, a magenta dye-forming coupler for a green light-sensitive emulsion layer, and a cyan dye-forming coupler for a red light-sensitive emulsion layer. However, the silver halide color photographic light-sensitive material is allowed to be prepared otherwise than the above combination according to the purpose for which the light-sensitive material is used.

The yellow dye-forming coupler includes acylacetamido couplers (such as benzoylacetanilides, pivaloylacetanilides); the magenta dye-forming coupler includes 5-pyrazolone couplers, pyrazolonebenzimidazole couplers, non-invention pyrazolotriazoles, open-chain acylacetonitrile couplers in addition to the magenta couplers of this invention; and the cyan dye-forming coupler includes naphthol couplers and phenol couplers, and the like.

These dye-forming couplers each is desirable to have in the molecule thereof a group called 'ballasting group' having not less than eight carbon atoms, which serves to make the coupler nondiffusible. And these dye-forming couplers may be either 4-equivalent couplers, wherein four silver ions are required to be reduced for the formation of one molecule of dye, or 2-equivalent couplers, wherein only two silver ions are required to be reduced.

Those hydrophobic compounds such as the dye-forming couplers, which are not required to be absorbed to the silver halide crystal surface, may be dispersed by various methods including the solid dispersion method, latex dispersion method, oil-in-water-type emulsification dispersion method, which may be arbitrarily selected according to the chemical structure of a hydrophobic compound such as the coupler used. Usable as the oil-in-water-type emulsification dispersion method are those conventionally known methods for dispersing hydrophobic additives such as couplers, which methods are normally such that a hydrophobic compound is dissolved into a high-boiling organic solvent whose boiling point is not less than 150° C., or, if necessary, into a mixture of the high-boiling solvent with a low-boiling and/or water-miscible organic solvent; the solution is emulsifiedly dispersed into a hydrophilic binder such as an aqueous gelatin solution with use of a surface active agent by means of a stirrier, homogenizer, colloid mill, flow-jet mixer, ultrasonic disperser, or the like; and the dispersed liquid is then incorporated into an objective hydrophilic colloidal layer. Into the above dispersing process may be inserted a process of removing the low-boiling solvent.

Those usable as the high-boiling solvent are organic solvents whose boiling point is not less than 150° C., such as phenol derivatives, phthalic acid esters, phosphoric acid esters, citric acid esters, benzoic acid esters, alkylamides, fatty acid esters, trimesic acid esters, and the like, which all are not reactive with the oxidized product of a developing agent.

Anionic surfactants, nonionic surfactants, or cationic surfactants may be used as the dispersing aid for use in dispersing mechanically or by use of ultrasonic waves into water a solution of a hydrophobic compound dissolved in a low-boiling solvent alone or in combination with a high-boiling solvent.

An anti-color-fogging agent may be used to prevent the color turbidity caused by the movement of the oxidized product of a developing agent or of the electron-transfer agent between the emulsion layers (between the same color sensitivity-having layers or between the different color sensitivity-having layers) of the color photographic light-sensitive material of the present invention; deterioration of the sharpness; and the conspicuousness of the graininess.

The anti-color-fogging agent may be used either in an emulsion layer itself or in an interlayer which is provided in between adjacent emulsion layers.

In the color light-sensitive material using the silver halide emulsion of this invention an image stabilizer may be used for preventing the deterioration of the produced dye image.

The light-sensitive material of the present invention may contain in its hydrophilic colloid layers such as the protective layer, interlayer, etc., a ultraviolet absorbing agent for the purpose of preventing the occurrence of fog due to the discharge possibly caused by the frictional charging of the light-sensitive material and also preventing the deterioration of the resulting image by ultraviolet rays.

The color light-sensitive material using the silver halide emulsion of this invention may be provided with auxiliary layers such as filter layers, antihalation layer and/or antiirradiation layer. In these layers and/or emulsion layers a dye may be contained which will flow out of the light-sensitive material or will be bleached in the course of the development process.

To the silver halide emulsion layers and/or other hydrophilic colloid layers of the silver halide light-sensitive material using the silver halide emulsion of this invention may be added a matting agent for the purpose of reducing the gloss of the light-sensitive material; improving the retouchability; and prevention of the sticking of the light-sensitive material to another.

To the light-sensitive material using the silver halide emulsion of this invention may be added a slipping agent in order to reduce the sliding friction thereof.

An antistatic agent may be added to the light-sensitive material using the silver halide emulsion of this invention for the purpose of preventing the charging of static electricity. The antistatic agent may be used in an antistatic layer that is provided on the non-emulsion-coated side of a support or may also be used in the emulsion layer and/or a protective colloid layer other than the emulsion layer on the emulsion layer side of the support.

The light-sensitive material using the silver halide emulsion of this invention may use in its photographic emulsion layers and/or other hydrophilic colloid layers surface active agents for the purpose of improving the coatability, preventing static electricity, improving slidability, improving emulsification dispersibility, preventing adherence, improving photographic characteristics (such as development accelerability, contrast increasability, sensitizability, etc.), and the like.

The emulsion layers and other layers of the light-sensitive materials using the silver halide of this invention may be coated on a support which includes flexible reflective supports such as a baryta layer-coated or α-olefinpolymer, etc., -laminated paper, synthetic paper, and the like; semi-synthetic or synthetic high-molecular films such as of cellulose acetate, cellulose nitrate, polystyrene, polyvinyl chloride, polyethyleneterephthalate, polycarbonate, polyamide, and the like; and solid materials such as glass, metals, ceramics, and the like.

The silver halide material of this invention may be coated directly (or indirectly through one or two or more subbing layers for improving the adherence of the support surface, antistatic characteristic, dimensional stability, wear resistance, hardness, antihalation characteristic, frictional characteristic, and/or other characteristics) on a support the surface of which is subjected, if necessary, to such a treatment as corona discharging, ultraviolet irradiation, flame treatment, or the like.

A viscosity-increasing agent may be used in the coating of the photographic light-sensitive material using the silver halide emulsion of this invention in order to improve the coatability thereof. For the coating, the extrusion coating and curtain coating methods are particularly useful which are capable of coating two or more layers simultaneously.

The light-sensitive material of this invention may be exposed to electromagnetic waves in the spectral regions to which the emulsion layers constituting the light-sensitive material of this invention are sensitive. As the light source for use in the exposure, any known light sources may be used which include the natural light (sunlight), tungsten lamp light, fluorescent lamp light, mercury-arc lamp light, xenon-arc lamp light, carbon-arc light, xenon flash light, cathod-ray-tube flying spot, various laser lights, light-emission diode light, light emitted from a phosphor excited by electron beams, X-rays, γ-rays, α-rays, etc., and the like.

The exposure time can be shorter than one microsecond, not to speak of one millisecond to one second exposure which is usually used for ordinary cameras; e.g., an exposure for 100 to 1 microsecond can be made using a cathode ray tube or xenon flash light; and also can be longer than one second. The exposure may be carried out either continuously or intermittently.

The silver halide photographic light-sensitive material of this invention forms an image when processed by the color development known to those skilled in the art.

The aromatic primary amine color developing agent to be used in the color developing liquid for the present invention includes those known compounds extensively used in various photographic color processes. These developing agents include aminophenol-type and p-phenylenediamine-type derivatives. Any of these compounds is used in the form of a salt, such as, e.g., hydrochloride or sulfate, because of being more stable than in a free state. And any of these compounds is normally used in a concentration of from about 0.1 g to about 30 g per liter of a color developer liquid, and preferably from about 1 g to about 1.5 g per liter of a color developer liquid.

An aminophenol-type developer liquid may contain a developing agent such as, e.g., o-aminophenol, p-aminophenol, 5-amino-2-oxytoluene, 2-amino-3-oxytoluene, 2-oxy-3-amino-1,4-dimethylbenzene, or the like.

Particularly useful aromatic primary amino-type color developing agents are N,N-dialkyl-p-phenylenediamine-type compounds, whose alkyl and phenyl groups each may have an arbitrary substituent. Especially useful compounds amon them include N'-dimethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-β-methanesulfonamidoethyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluene sulfonate, and the like.

A color developer liquid for use in the processing of the light-sensitive material of this invention may arbitrariy contain, in addition to the above aromatic primary amine-type color developing agent, various components usually used color developers, including alkaline agents such as sodium hydroxide, sodium carbonate, potassium carbonate, etc., alkaline metal sulfites, alkaline metal hydrogensulfite, alkaline metal thiocyanates, alkaline metal halides, benzylalcohol, water softener, thickening gent, and the like. The pH value of the color developer liquid is normally not less than 7, and most generally from about 10 to about 13.

In the present invention, the light-sensitive material is processed in a color developer, and then processed in a processing solution having a fixing ability. Where this processing solution having a fixing ability is a fixer liquid, a bleaching treatment takes place prior to the fixing. Those usable as the bleaching agent for use in the bleaching process include metal complex salts of organic acids, and the metal complex salt functions to oxidize the metallic silver formed by development into a silver halide, and at the same time also functions to color-develop the un-color-developed portion of the color developing agent. And its construction is an organic acid such as aminopolycarboxylic acid, oxalic acid, citric acid, or the like, to which are coordinated metallic ions such as of iron, cobalt, coupper, or the like. The most preferred organic acids for use in the formation of metal complexes of such organic acids are polycarboxylic acids and aminopolycarboxylic acids. These polycarboxylic acids or aminopolycarboxylic acids msy be alkaline metallic salts, ammonium salts, or water-soluble amine salts.

The following are examples of these acids and salts:

[1] Ethylenediaminetetraacetic acid,
[2] Nitrileotriacetic acid,
[3] Iminodiacetic acid,
[4] Disodium ethylenediamine tetraacetate,
[5] Tetra(trimethylammonium) ethylenediamine tetraacetate,
[6] Tetrasodium ethylenediaminetetraacetate, and
[7] Sodium nitrilotriacetate.

The bleaching agent to be used may contain the foregoing metallic complex of an organic acid, and also may contain various additives, which include particularly alkaline halides or ammonium halides, e.g., rehalogenating agents such as potassium bromide, sodium bromide, sodium chloride, ammonium bromide, etc., metallic salts, chelating agents, and the like. And those known to be usually added to bleaching liquids including pH buffers such as borates, oxalates, acetates, carbonates, phosphates, etc., alkylamines, polyethylene oxides, and the like may also be arbitrarily added.

Further, the fixer and bleach-fix liquids may contain alone or in combination pH buffers comprising various salts including sulfites such as ammonium sulfite, potassium sulfite, ammonium hydrogensulfite, potassium hydrogensulfite, sodium hydrogensulfite, ammonium metabisulfite, potassium metabisulfite, sodium metabisulfite, etc., and various salts such as boric acid, borax, sodium hydroxide, potassium hydroxide, sodium carbonate, potassium carbonate, sodium hydrogensulfite, sodium hydrogencarbonate, potassium hydrogencarbonate, acetic acid, sodium acetate, ammonium hydroxide, and the like.

Where the processing of this invention takes place with the bleach-fix bath being replenished with a bleach-fix replenisher, the bleach-fix bath may contain a thiosulfate, thiocyanate, or sulfite etc., or the bleach-fix replenisher may contain the same to replenish the bleach-fix bath.

In the present invention, in order to raise the activity of the bleach-fix bath, into the bleack-fix bath and into the bleach-fix replenisher storage tank may, if desired, be blown air or oxygen. Alternatively, an appropriate oxidizing agent such as hydrogen peroxide, a bromate, a persulfate, or the like may be arbitrarily added.

EXAMPLES

The present invention will be further detailed by the following examples, but the embodiments of the invention are not limited thereto.

EXAMPLE 1

Forty grams of the foregoing exemplified magenta coupler (I-6) were dissolved into a mixture solvent of 40 ml of dioctyl phthalate and 100 ml of ethyl acetate, and the solution was added to 300 ml of an aqueous 5% gelatin solution containing sodium dodecylbenzenesulfonate. The dispersed liquid obtained by dispersing the mixture by means of a homogenizer was mixed into 500 g of a green-sensitive silver chlorobromide emulsion (containing 30 g of Ag), and then a coating aid was added to the emulsion, whereby a coating liquid was prepared. The coating liquid was subsequently coated on a polyethylene-coated paper support, and on the coated layer was further coated a coating liquid as a protective layer containing 2-(2'-hydroxy-3,5-di-t-amylbenzotriazole), gelatin, coating aid, and hardener.

The 2-(2'-hydroxy-3,5-di-t-amylbenzotriazole) was coated so that its coating quantity is 5 mg/dm$^2$, and gelatin was coated so that its coating quantity is 15 mg/dm$^2$, and thus a silver halide photographic light-sensitive material was obtained, which was regarded as Sample 1.

Samples 2 through 15 were prepared in the same manner as Sample 1 except that the metallic complexes as shown in Table 1 were added in combination as shown in the same table. The adding quantity of each of the complexes was 50 mole % to the coupler.

These samples each was exposed through an optical wedge by use of a sensitometer (KS-7, manufactured by Konishiroku Photo Industry Co., Ltd.), and then processed in the following steps:

| Standard processing steps (temperature and time) | |
|---|---|
| [1] Color development | at 38° C. 3 min. and 30 sec. |
| [2] Bleach-fix | at 33° C. 1 min. and 30 sec. |
| [3] Washing | at 25~30° C. 3 min. |
| [4] drying | at 75~80° C. about 2 min. |

| Compositions of processing liquids | |
|---|---|
| (Color developer tank liquid) | |
| Benzylalcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-methyl-4-amino-N-(β-methanesulfonamidoethyl)aniline sulfate | 5.5 g |
| Brightening agent (4,4'-diaminostilbenesulfonic acid derivative | 1.0 g |
| Potassium hydroxide | 2.0 g |
| Water to make 1 liter, the pH is adjusted to | 10.20. |
| (Bleach-fix tank liquid) | |
| Ferric-ammonium ethylenediaminetetraacetate, dihydrated | 60 g |
| Ethylenediaminetetraacetic acid | 3 g |
| Ammonium thiosulfate (70% solution) | 100 ml |
| Ammonium sulfite (40% solution) | 27.5 ml |
| Use potassium carbonate or glacial acetic acid to adjust the pH to 7.1, and add water to make the whole quantity 1 liter. | |

After the processing, the light resistance and yellow stain by heat of each of the samples were measured by the following procedure:

[Light resistance examination]

The discoloration degree $$\left(\frac{D_0 - D}{D0} \times 100, D_0\text{: initial density (1.0)},\right.$$

D: density after discoloration) when the dye image formed on each sample was exposed for 40 days to the sunlight by use of a underglass outdoor exposure stand was measured.

[Yellow stain by heat examination]

Each sample was stored for 20 days and 40 days in an incubation cabinet kept at 80° C. with no humidification.

The difference (increase in density) in the blue-light-reflection density of the white area of each sample between before and after the storage thereof was measured, and it was regarded as thermal yellow staining degree.

The results of these examinations are as given in Table 1.

TABLE 1

| Sample No. | Magenta coupler | Metallic complex | Light resistance discoloration % | Yellow stain by heat 20 days | Yellow stain by heat 40 days |
|---|---|---|---|---|---|
| 1(Comp.) | I-6 | — | 84 | 0.06 | 0.15 |
| 2(Inv.) | I-6 | II-20 | 18 | 0.07 | 0.17 |
| 3(Inv.) | I-6 | II-22 | 20 | 0.07 | 0.17 |
| 4(Comp.) | I-7 | — | 83 | 0.05 | 0.14 |
| 5(Inv.) | I-7 | II-20 | 17 | 0.06 | 0.15 |
| 6(Inv.) | I-7 | II-22 | 18 | 0.06 | 0.15 |
| 7(Comp.) | I-32 | — | 81 | 0.05 | 0.13 |
| 8(Inv.) | I-32 | II-20 | 17 | 0.06 | 0.14 |
| 9(Inv.) | I-32 | II-22 | 15 | 0.07 | 0.15 |
| 10(Comp.) | Comp. magenta coupler-1 | — | 95 | 0.07 | 0.15 |
| 11(Comp.) | Comp. magenta coupler-1 | II-20 | 51 | 0.015 | 0.35 |
| 12(Comp.) | Comp. magenta coupler-1 | II-22 | 57 | 0.018 | 0.36 |
| 13(Comp.) | Comp. magenta coupler-2 | — | 92 | 0.06 | 0.15 |
| 14(Comp.) | Comp. magenta coupler-2 | II-20 | 31 | 0.08 | 0.31 |
| 15(Comp.) | Comp. magenta | II-22 | 34 | 0.08 | 0.29 |

TABLE 1-continued

| Sample No. | Magenta coupler | Metallic complex | Light resistance discoloration % | Yellow stain by heat 20 days | 40 days |
|---|---|---|---|---|---|
| | coupler-2 | | | | |

Comparative Magenta Coupler 1

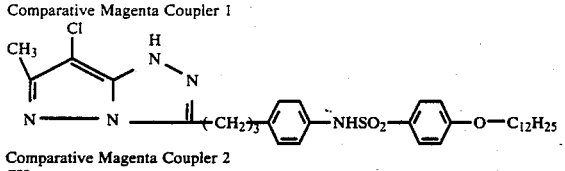

Comparative Magenta Coupler 2

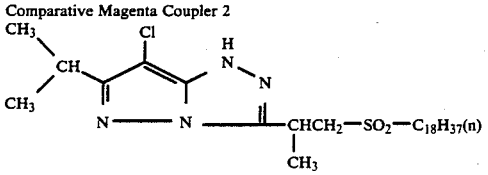

As is apparent from Table 1, any of the comparative samples 1, 4, 7, 10 and 13, which do not contain the metallic complex of this invention, shows a large degree of discoloration and is very poor in the light resistance. Samples 11 and 12, wherein the metallic complex of this invention is used in Comparative Coupler 1, show little improvement on the light resistance and a remarkable increase in the yellow stain by heat, so that the white area of the resulting photographic image is stained yellowish-orange, thus being not worth seeing.

Samples 14 and 15, wherein the metallic complex of this invention is used in Comparative Magenta Coupler 2, are improved on the light resistance and prevented from being increasingly yellow-stained by heat, but not sufficient; the yellow stain becomes conspicuously increased particularly when stored over a long period.

However, these samples of this invention, wherein the magenta coupler of this invention and the metallic complex of this invention are used in combination, show much improvement on the light resistance and also show no increase in the yellow stain by heat even after a long-period storage thereof.

These functional effects were not expected from the results of the comparative samples.

EXAMPLE 2

On a polyethylene-coated paper support were coated the following layers in order from the support side, whereby a multicolor silver halide photographic light-sensitive material was prepared.

Layer 1: Blue-sensitive silver halide emulsion layer 8 mg/dm$^2$ of α-pivalyl-α-(1-benzyl-2,4-dioxo-imidalysine-3-yl)-2-chloro-5-[γ-(2,4-di-t-amylphenoxy)-butylamido]-acetanilide as an yellow coupler, 3 mg/dm$^2$ in silver equivalent of a blue-sensitive silver chlorobromide emulsion, 3 mg/dm$^2$ of 2,4-di-t-butylphenol-3',5'-di-t-amyl-4'-hydroxybenzoate, 3 mg/dm$^2$ of dioctylphthalate and 16 mg/dm$^2$ of gelatin were coated.

Layer 2: Interlayer

Gelatin was coated so that its coating quantity is 4 mg/dm$^2$.

Layer 3: Green-sensitive silver chlorobromide emulsion layer 4 mg/dm$^2$ of the foregoing magenta coupler (I-6), 2 mg/dm$^2$ in silver equivalent of a green-sensitive silver chlorobromide emulsion, 4 mg/dm$^2$ of dioctylphthalate and 16 mg/dm$^2$ of gelatin were coated.

Layer 4: Interlayer 3 mg/dm$^2$ of an ultraviolet absorbing agent 2-hydroxy-3',5'-di-t-amylphenol)-benzotriazole, 3 mg/dm$^2$ of 2-(2'-hydroxy-3',5'-di-t-butylphenol)-benzotriazole, 4 mg/dm$^2$ of diocyl phthalate and 14 mg/dm$^2$ of gelatin were coated.

Layer 5: Red-sensitive silver chlorobromide emulsion layer 1 mg/dm$^2$ of a cyan coupler 2,4-dichloro-3-methyl-6-[α-(2,4-di-t-amylphenoxy)butylamido]-phenol, 3 mg/dm$^2$ of 2-(2,3,4,5,6-pentafluorophenyl)-acylamino-4-chloro-5-[α-(2,4-di-t-tert-amylphenoxy)pentyl amido], 2 mg/dm$^2$ of diocyl phthalate and 3 mg/dm$^2$ in silver equivalent of a red-sensitive silver chlorobromide emulsion were coated.

Layer 6: Interlayer 2 mg/dm$^2$ of an ultraviolet absorbing agent 2-(2'-hydroxy-3',5'-di-t-amylphenol)-benzotriazole, 2 mg/dm$^2$ of 2-(2'-hydroxy-3',5'-di-t-butylphenol)-benzotriazole, 2 mg/dm$^2$ of dioctyl phthalate, and 6 mg/dm$^2$ of gelatin were coated.

Layer 7: Protective layer

Gelatin was coated so that its coating quantity is 9 mg/dm$^2$.

The thus prepared sample was regarded as Sample 16.

Subsequently, Samples 17 through 30 were prepared in the same manner as in Sample 16 except that the magenta coupler-metallic complex combination in the third layer of Sample 16 was replaced by those as shown in Table 2. Each of the metallic complexes used was added in a quantity of 50 mole % to the coupler.

The thus prepared samples each was subjected to the same exposure and processing as those made in Example 1, provided that the exposure was made using a green light in order to obtain magenta monochromatic samples. The thus processed samples each was examined with respect to the light resistance of the magenta dye image and the yellow stain on the white area by heat in the same manner as in Example 1.

The results are as shown in Table 2.

TABLE 2

| Sample No. | Magenta coupler | Metallic complex | Light resistance discoloration % | Yellow stain by heat 20 days | 40 days |
|---|---|---|---|---|---|
| 16(Comp.) | I-1 | — | 86 | 0.06 | 0.14 |
| 17(Inv.) | I-1 | II-18 | 23 | 0.07 | 0.16 |
| 18(Inv.) | I-6 | II-18 | 17 | 0.07 | 0.16 |
| 19(Inv.) | I-8 | II-18 | 16 | 0.08 | 0.15 |
| 20(Inv.) | I-12 | II-18 | 18 | 0.07 | 0.17 |
| 21(Inv.) | I-32 | II-18 | 15 | 0.06 | 0.15 |
| 22(Inv.) | I-35 | II-18 | 14 | 0.06 | 0.16 |
| 23(Inv.) | I-41 | II-18 | 16 | 0.07 | 0.15 |
| 24(Comp.) | Comp. magenta coupler-1 | II-18 | 45 | 0.14 | 0.37 |
| 25(Inv.) | I-35 | II-6 | 27 | 0.09 | 0.24 |
| 26(Inv.) | I-35 | II-10 | 28 | 0.08 | 0.23 |
| 27(Inv.) | I-35 | II-18 | 17 | 0.07 | 0.17 |
| 28(Inv.) | I-35 | II-21 | 13 | 0.06 | 0.14 |
| 29(Inv.) | I-35 | II-26 | 12 | 0.06 | 0.14 |
| 30(Comp.) | I-35 | Comp. metallic | 43 | 0.15 | 0.38 |

TABLE 2-continued

| Sample No. | Magenta coupler | Metallic complex | Light resistance discolor-ation % | Yellow stain by heat 20 days | 40 days |
|---|---|---|---|---|---|
| | | complex-1 | | | |

The comparative coupler 1 used in the above is the same as that used in Example 1.
Comparative Metallic Complex 1

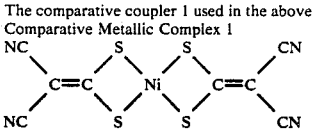

As is apparent from Table 2, Sample 16, which does not contain the metallic complex of this invention, and Samples 24 and 30, which contain the comparative magenta coupler and comparative metallic complex, are disadvantageous in respect that the improvement on the light resistance is not sufficient or the yellow stain by heat increases.

On the other hand, these samples of this invention show much improvement on the light resistance as well as on the yellow stain by heat, particularly, after a long-period storage.

EXAMPLE 3

Samples 31 through 39 were prepared each having the same construction as that in Example 2 except that the layer 3 thereof contains the magenta coupler and metallic complex in the combination as given in Table 3. The metallic complex was used in a quantity of 50 mole %, and the oxidation inhibitor was used in a quantity of 100 mole % to the coupler used.

The thus prepared samples each was subjected to the same exposure and processing as those used in Example 2.

The thus processed samples each was examined in the same manner as in Example 1 with respect to the light resistance of the magenta dye image amd the yellow stain of the white area by heat. The results are as given in Table 3.

TABLE 3

| Sample No. | Magenta coupler | Metallic complex | Light resistance discolor-ation % | Yellow stain by heat 20 days | 40 days |
|---|---|---|---|---|---|
| 31 (Comp.) | I-12 | — | 83 | 0.05 | 0.13 |
| 32 (Comp.) | I-21 | — | 82 | 0.06 | 0.14 |
| 33 (Comp.) | I-24 | — | 82 | 0.06 | 0.13 |
| 34 (Comp.) | I-25 | — | 77 | 0.05 | 0.13 |
| 35 (Inv.) | I-12 | II-18 | 18 | 0.07 | 0.17 |
| 36 (Inv.) | I-21 | II-18 | 16 | 0.08 | 0.16 |
| 37 (Inv.) | I-24 | II-18 | 16 | 0.09 | 0.16 |
| 38 (Inv.) | I-25 | II-18 | 13 | 0.07 | 0.14 |
| 39 (Comp.) | I-25 | Comp. metallic complex-1 | 41 | 0.15 | 0.36 |

*Comparative Metallic Complex-1 in the above is the same as that used in Example 1.

As is apparent from Table 3, these samples of this invention are largely improved on the light resistance of the magenta dye image and prevented from the increase in the yellow stain by heat.

And these samples containing the comparative metallic complex show the deterioration of the whiteness by the color of the comparative metallic complex itself and decrease in the sensitivity, thus adversely affecting the photographic characteristics. In these samples of the present invention, however, change in the photographic characteristics was so small that satisfactory color images were obtained.

Regarding the color tone of the magenta dye image, the yellow component in the proximity of 430 nm was so small and the absorption spectrum of the visible rays in the proximity of 560 nm was so sharp that a very clear and sharp magenta dye image was obtained.

What is claimed is:

1. A silver halide photographic light-sensitive material which comprises at least one of 1H-pyrazolo[5,1-C]-1,2,4-triazole-type magenta couplers substituted by a compound having the following Formula [I] in the third position and at least one of these compounds having the following Formulas [II], [III] and [IV];

$$-R^1-SO_2-R^2 \qquad \text{Formula [I]}$$

wherein $R^1$ is an alkylene group having not less than three carbon atoms in the straight-chain portion which serves as an linkage group between the third-position carbon of the 1H-pyrazolo[5,1-C]-1,2,4-triazole and the $-SO_2-$, and $R^2$ is an alkyl group, a cycloalkyl group, or aryl group;

Formula [II]

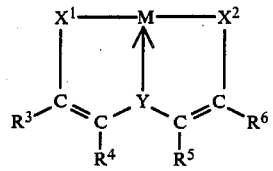

Formula [III]

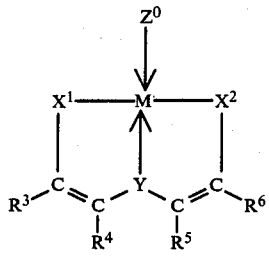

Formula [IV]

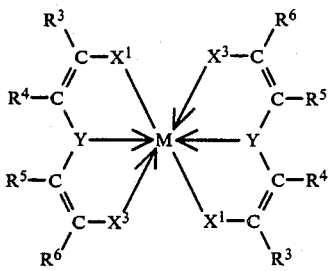

in Formula [II], Formula [III] and Formula [IV], M is a metallic atom; $X^1$ and $X^2$ each is an oxygen atom, a sulfur atom, or a $-NR^7-$ (wherein $R^7$ is a hydrogen atom, an alkyl group, an aryl group or a hydroxyl group); $X^3$ is a hydroxyl group or a mercapto group; Y is an oxygen atom or a sulfur atom; $R^3$, $R^4$, $R^5$ and $R^6$ each is a hydrogen atom, a halogen atom, a cyano group, or an alkyl, aryl, cycloalkyl or heterocyclic group which combines with a carbon atom directly or through a divalent linkage group; and at least one of the $R^3$–$R^4$ and $R^5$–$R^6$ combinations may be allowed to combine along with carbon atoms to form a five- or six-member ring; further $Z^0$ represents a compound or a residue thereof coordinatable to M.

2. The silver halide photographic light-sensitive material as claimed in claim 1, wherein said 1H-pyrazolo-[5,1-C]-1,2,4-triazole-type magenta couplers have the following Formula [II]:

Formula [II]

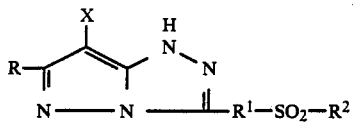

wherein $R^1$ and $R^2$ are the same as the $R^1$ and $R^2$ defined in Formula [I]; R represents a hydrogen atom or a substituent; and X represents a hydrogen atom or a substituent that can be split off as a result of the reaction with the oxidation product of a color developing agent.

3. The silver halide photographic light-sensitive material as claimed in claim 2, wherein R is an alkyl group.

4. The silver halide photographic light-sensitive material as claimed in claim 2, wherein R has the following Formula [III]:

Formula [III]

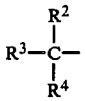

wherein $R_2$, $R_3$ and $R_4$ each represents a hydrogen atom, a halogen atom, an alkyl, cycloalkyl, alkenyl, cycloalkenyl, alkinyl, aryl, heterocyclic, acyl, sulfonyl, sulfinyl, phosphonyl, carbamoyl, sulfamoyl, cyano, spiro compound residue, cross-linked hydrocarbon compound residue, alkoxy, aryloxy, heterocyclic oxy, siloxy, acyloxy, carbamoyloxy, amino, acylamino, sulfonamido, imido, ureido, sulfamoylamino, alkoxycarbonylamino, aryloxycarbonylamino, alkoxycarbonyl, aryloxycarbonyl, alkylthio, arylthio or heterocyclic thio group, provided that at least two of the $R_2$, $R_3$ and $R_4$ are not hydrogen; and two of the foregoing $R_2$, $R_3$ and $R_4$; for example, $R_2$ and $R_3$, may be combined to form a saturated or unsaturated ring and further to the ring may be combined $R_4$ to constitute a cross-linked hydrocarbon compound residue.

5. The silver halide photographic light-sensitive material as claimed in claim 4, wherein two of $R_2$ through $R_4$ in Formula [III] are an alkyl group, and one of $R_2$ through $R_4$ is a hydrogen atom, and the other two, $R_2$ and $R_3$, are combined to form a cycloalkyl group along with the closest carbon atom.

6. The silver halide photographic light-sensitive material as claimed in claim 1, wherein compounds having Formulas [II], [III] and [IV] are those having the following Formula [IIa], [IIIa] and [IVa], respectively.

Formula [IIa]

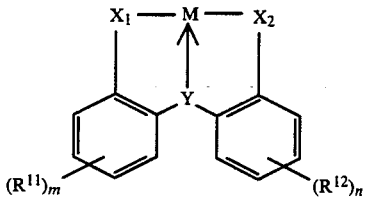

-continued

Formula [IIIa]

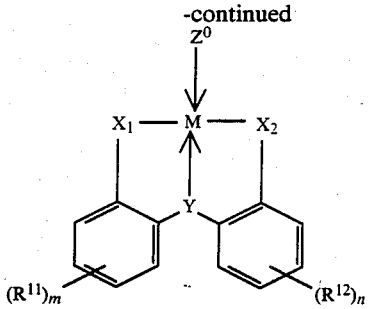

Formula [IVa]

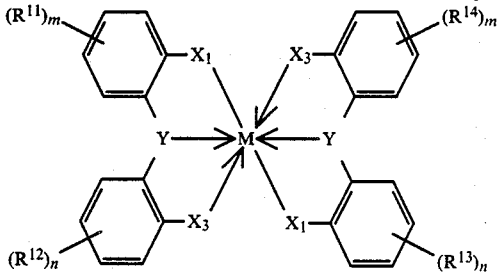

in Formulas [IIa], [IIIa] and [IVa], M, $X_1$, $X_2$, $X_3$, Y and $Z^0$ are as defined previously;

in Formulas [IIa], [IIIa] and [IVa], $R^{11}$, $R^{12}$, $R^{13}$ and $R^{14}$ each is an alkyl group, an aryl group, an alkoxy group, an aryloxy group, an alkoxycarbonyl group, an aryloxycarbonyl, an acyl group, an acylamino group, an arylamino group, an alkylamino group, a carbamoyl group, sulfamoyl group, a sulfonamido group, a sulfonyl group, or an cycloalkyl group, and m and n each is an integer of from zero up to 4.

7. The silver halide photographic light-sensitive material as claimed in claim 1, wherein said compounds represents by Formula [II], [III] and [IV] are represents by Formula [IIIb]:

Formula [IIIb]

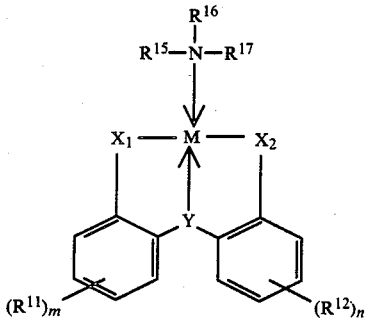

wherein M, $X_1$, $X_2$, Y, $R^{11}$, $R^{12}$, m and n are as defined previously; and $R^{15}$, $R^{16}$ and $R^{17}$ each represents a hydrogen atom, an alkyl group, or an aryl group, provided that each of at least two of $R^{15}$, $R^{16}$ and $R^{17}$ represents an alkyl or aryl group.

8. The silver halide photographic light-sensitive material as claimed in claim 7, wherein X, and $X_2$ each are oxygen, and Y is sulfur.

9. The silver halide photographic light-sensitive material as claimed in claim 8, wherein M is nickel.

10. The silver halide photographic light-sensitive material as claimed in claim 1, wherein the content of said coupler having the Formula [I] is from $1\times10^{-2}$ mol to $8\times10^{-1}$ mol per mol of a silver halide.

11. The silver halide photographic light-sensitive material as claimed in claim 1, wherein the content of said compounds having the Formula [II], [III] or [IV] is from 5 to 100% by weight of the coupler of the invention.

* * * * *

UNITED STATES PATENT AND TRADEMARK OFFICE

CERTIFICATE OF CORRECTION

PATENT NO. : 4,912,027

DATED : March 27, 1990

INVENTOR(S) : NISHIJIMA et al

It is certified that error appears in the above-identified patent and that said Letters Patent is hereby corrected as shown below:

Title Page, left column, [73] Assignee:

Replace "Konishiroku Photo Industry Co., Ltd., Tokyo, Japan"

with --Konica Corporation, Tokyo, Japan--.

Signed and Sealed this

Twelfth Day of October, 1993

*Attest:*

*Attesting Officer*

Bruce Lehman

BRUCE LEHMAN

*Commissioner of Patents and Trademarks*